US011679047B2

(12) United States Patent
Wijesundara et al.

(10) Patent No.: US 11,679,047 B2
(45) Date of Patent: Jun. 20, 2023

(54) PRESSURE MODULATING SOFT ACTUATOR ARRAY DEVICES AND RELATED SYSTEMS AND METHODS

(71) Applicant: THE BOARD OF REGENTS OF THE UNIVERSITY OF TEXAS SYSTEM, Austin, TX (US)

(72) Inventors: Muthu Wijesundara, Arlington, TX (US); Wei Carrigan, Arlington, TX (US)

(73) Assignee: The Board of Regents of the University of Texas System, Austin, TX (US)

( * ) Notice: Subject to any disclaimer, the term of this patent is extended or adjusted under 35 U.S.C. 154(b) by 691 days.

(21) Appl. No.: 16/606,627

(22) PCT Filed: Apr. 20, 2018

(86) PCT No.: PCT/US2018/028599
§ 371 (c)(1),
(2) Date: Oct. 18, 2019

(87) PCT Pub. No.: WO2018/195444
PCT Pub. Date: Oct. 25, 2018

(65) Prior Publication Data

US 2021/0113402 A1 Apr. 22, 2021

Related U.S. Application Data

(60) Provisional application No. 62/491,607, filed on Apr. 28, 2017, provisional application No. 62/488,055, filed on Apr. 20, 2017.

(51) Int. Cl.
*A61G 7/057* (2006.01)
*A47C 27/10* (2006.01)
(Continued)

(52) U.S. Cl.
CPC ..... *A61G 7/05776* (2013.01); *A47C 27/10* (2013.01); *A61G 7/05769* (2013.01);
(Continued)

(58) Field of Classification Search
CPC ..... A47C 27/082; A47C 27/081; A47C 27/08; A47C 27/10; A47C 27/18; A47C 27/083;
(Continued)

(56) References Cited

U.S. PATENT DOCUMENTS 3,283,799 A 11/1966 Barbera
3,538,628 A 11/1970 Einstein
(Continued)

FOREIGN PATENT DOCUMENTS

AU 2012261500 A1 * 6/2013 ..... A47C 27/083
DE 102016218632 A1 3/2017
(Continued)

OTHER PUBLICATIONS

Aubin et al., "A pediatric robotic thumb exoskeleton for at-home rehabilitation : The isolated orthosis for thumb actuation (IOTA)"., International Journal of Intelligent Computing and Cybernetics 7(3), 2014.

(Continued)

*Primary Examiner* — Robert G Santos
(74) *Attorney, Agent, or Firm* — Meunier Carlin & Curfman LLC

(57) ABSTRACT

Pressure modulating soft actuator array devices and related systems and methods. One example of the present systems comprises: a device having a body that defines a plurality of cavities; a pressure source configured to be in fluid communication with the plurality of cavities; a plurality of sensors configured to capture data indicative of pressure within the plurality of cavities; and one or more controllers configured to actuate the pressure source to move fluid
(Continued)

toward and/or away from one or more of the plurality of cavities in response to data captured by the plurality of sensors; wherein the device is configured to be disposed between a user and a surface on which the user is seated upon.

18 Claims, 28 Drawing Sheets

(51) Int. Cl.
*A47C 27/08* (2006.01)
*A47C 27/18* (2006.01)

(52) U.S. Cl.
CPC ..... *A47C 27/082* (2013.01); *A47C 27/083* (2013.01); *A47C 27/18* (2013.01); *A61G 2203/20* (2013.01); *A61G 2203/34* (2013.01); *A61G 2203/44* (2013.01)

(58) Field of Classification Search
CPC ..... A61G 7/05769; A61G 7/05776; A61G 2203/20; A61G 2203/34; A61G 2203/44
USPC ..... 5/713, 710, 706, 644, 654, 655.3
See application file for complete search history.

(56) References Cited

U.S. PATENT DOCUMENTS 3,574,386 A 4/1971 Frost
3,834,046 A 9/1974 Fowler
5,156,629 A 10/1992 Shane et al.
5,237,501 A 8/1993 Gusakov
5,267,365 A 12/1993 Walter
5,423,094 A 6/1995 Arsenault et al.
5,873,137 A * 2/1999 Yavets-Chen ..... A61G 7/05776 5/713
5,881,407 A 3/1999 Chup Pt
5,916,664 A 6/1999 Rudy
6,092,249 A 7/2000 Kamen et al.
6,560,803 B2 5/2003 Zur
6,585,328 B1 * 7/2003 Oexman ..... G01M 99/001 5/706
6,859,967 B2 * 3/2005 Harrison ..... A61G 7/05776 5/713
7,409,735 B2 * 8/2008 Kramer ..... A61G 7/015 5/709
8,127,373 B1 3/2012 Fodemski
8,286,282 B2 * 10/2012 Kummer ..... A61G 7/015 5/713
8,523,794 B2 9/2013 Iker et al.
8,875,331 B2 * 11/2014 Taylor ..... A61B 5/1126 5/613
9,468,307 B2 * 10/2016 Lafleche ..... A61B 5/6892
9,661,928 B2 * 5/2017 Patrick ..... B64D 11/0647
10,682,273 B2 * 6/2020 Lafleche ..... A61B 5/6892
10,857,054 B2 * 12/2020 DuBois ..... A61G 13/128
11,013,344 B2 * 5/2021 Mackey ..... A47C 27/088
11,191,367 B2 * 12/2021 Arzanpour ..... A47C 7/144
11,191,687 B2 * 12/2021 Sachdev ..... A47C 27/082
11,266,353 B2 * 3/2022 Massak ..... A61G 5/1043
2002/0004120 A1 1/2002 Hillier
2002/0128572 A1 9/2002 Chang
2003/0009913 A1 1/2003 Potter et al.
2003/0131417 A1 7/2003 Roux
2003/0159219 A1 * 8/2003 Harrison ..... A61G 7/05769 5/713
2003/0181990 A1 9/2003 Phillips
2004/0083550 A1 5/2004 Graebe
2005/0043585 A1 2/2005 Datta et al.
2006/0085919 A1 * 4/2006 Kramer ..... A61G 7/05776 5/713
2006/0174518 A1 8/2006 Fogarty et al.
2009/0000037 A1 1/2009 Graebe
2011/0094040 A1 * 4/2011 deGreef ..... A61G 7/05776 700/282
2011/0163885 A1 7/2011 Poulos et al.
2011/0173758 A1 * 7/2011 Fontaine ..... A61G 7/05715 5/709
2012/0054965 A1 3/2012 Kummer et al.
2013/0180530 A1 7/2013 Choi et al.
2014/0013514 A1 1/2014 Misaki
2014/0026327 A1 1/2014 Taylor
2014/0059781 A1 * 3/2014 Lafleche ..... A61B 5/0205 5/713
2014/0101861 A1 4/2014 Gowda et al.
2014/0167460 A1 6/2014 Prexl et al.
2015/0013073 A1 * 1/2015 Schwirian ..... A47C 27/083 5/655.3
2015/0335167 A1 11/2015 Cinquin
2016/0252110 A1 9/2016 Galloway
2017/0027792 A1 * 2/2017 Lafleche ..... A61B 5/6892
2017/0086588 A1 3/2017 Patrick et al.
2017/0135890 A1 * 5/2017 DuBois ..... A61G 13/1295
2017/0202366 A1 * 7/2017 Mackey ..... A47C 27/10
2018/0199729 A1 * 7/2018 Bullard ..... A47C 7/142
2018/0228441 A1 * 8/2018 Massak ..... A61G 5/1048
2019/0183257 A1 * 6/2019 Arzanpour ..... A47C 7/144
2019/0350786 A1 * 11/2019 Sachdev ..... A61G 5/1043
2020/0297564 A1 * 9/2020 Lafleche ..... A61B 5/6892
2020/0360211 A1 * 11/2020 Chee ..... A61B 5/002
2021/0113402 A1 * 4/2021 Wijesundara ..... A61G 7/05776

FOREIGN PATENT DOCUMENTS

KR 2007/0090474 9/2007
WO WO-9748314 A1 * 12/1997 ..... A61G 7/05776
WO 2009120270 A2 10/2009
WO WO-2009155595 A2 * 12/2009 ..... A61G 7/05715
WO WO/15/191007 12/2015
WO WO-2018195444 A1 * 10/2018 ..... A47C 27/082
WO WO-2019035762 A1 * 2/2019 ..... A61B 5/002

OTHER PUBLICATIONS

Balasubramanian et al., "Robot-assisted rehabilitation of hand function" Curr. Opin. Neurol. 23(6), 2010. Available: http://journals.lww.com/co-neurology/Fulltext/2010/12000/Robot_assisted_rehabilitation_of_hand_function.19.aspx.

Birch et al., "Design of a continuous passive and active motion device for hand rehabilitation", Presented at Engineering in Medicine and Biology Society, 2008. EMBS 2008. 30th Annual International Conference of the IEEE. 2008, . DOI: 10.1109/IEMBS.2008.4650162.

Board, et al. "A comparison of trans-tibial amputee suction and vacuum socket conditions." *Prosthetics and Orthotics International*, 25(3);202-209, 2001.

Brand, "Tenderizing the Foot," *Foot & Ankle International*, 24(6); 457-461, 2003.

Bus, et al., "The Effectiveness of Footwear and Offloading Interventions to Prevent and Heal Foot Ulcers and Reduce Plantar Pressure in Diabetes: A Systematic Review," *Diabetes Metabolism Research & Reviews*, 24 (S1); 99-118, 2008.

Chantelau, et al., "How Effective is Cushioned Therapeutic Footwear in Protecting Diabetic Feet? A Clinical Study," *Diabetic Medicine*, 7(4); 355-359, 1990.

Connelly et al., "A pneumatic glove and immersive virtual reality environment for hand rehabilitative training after stroke" Neural Systems and Rehabilitation Engineering, IEEE Transactions on 18(5), pp. 551-559. 2010. DOI: 10.1109/TNSRE.2010.2047588.

Convery & Buis, "Conventional Patellar-Tendon-Bearing (PTB) Socket/Stump Interface Dynamic Pressure Distributions Recorded During the Prosthetic Stance Phase of Gait of a Trans-Tibial Amputee," *Prosthetics and Orthotics International*, 22(3);193-198, 1998.

Dargis, et al., "Benefits of a Multidisciplinary Approach in the Management of Recurrent Diabetic Foot Ulceration in Lithuania: A Prospective Study," *Diabetes Care*, 22(9); 1428-1431, 1999.

(56) References Cited

OTHER PUBLICATIONS

Edmonds, et al., "Improved Survival of the Diabetic Foot: The Role of a Specialized Foot Clinic," *Quarterly Journal of Medicine*, 60(232); 763-771, 1986.
Faudzi, et al., "Design and Control of New Intelligent Pneumatic Cylinder for Intelligent Chair Tool Application," 2009 IEEE/IAS International Conference on Advanced Intelligent Mechatronics, Singapore, 1909-1914, 2009.
Hagberg & Branemark, "Consequences of Non-Vascular Trans-Femoral Amputation: A Survey of Quality of Life, Prosthetic Use and Problems." *Prosthetics and Orthotics International*, 25(3); 186-194, 2001.
Haghshenas-Jaryani M, Carrigan W, Wijesundara MBJ: "Design and Development of a Novel Soft-and-Rigid Actuator System for Robotic Applications", Paper No. 47761, Proceedings of the ASME 2015 International Design Engineering Technical Conferences & Computers and Information in Engineering Conference IDETC/CIE2015 Aug. 2-5, 2015, Boston, MA, USA.
Hamanami, et al., "Finding the Optimal Setting of Inflated Air Pressure for a Multi-Cell Air Cushion for Wheelchair Persons with Spinal Cord Injury," *Acta Medica Okayama*, 58(1): 37-44, 2004.
Heo and Kim, "Power-assistive finger exoskeleton with a palmar opening at the fingerpad" Biomedical Engineering, IEEE Transactions on 61(11), pp. 2688-2697. 2014. . DOI: 10.1109/TBME.2014.2325948.
Ho et al., "An EMG-driven exoskeleton hand robotic training device on chronic stroke subjects: Task training system for stroke rehabilitation" Presented at Rehabilitation Robotics (ICORR), 2011 IEEE International Conference on. 2011, . DOI: 10.1109/ICORR.2011.5975340.
Hume et al., "Functional range of motion of the joints of the hand," J.Hand Surg., vol. 15, No. 2, March pp. 240-243. 1990.
International Preliminary Report on Patentability in International Application No. PCT/US2014/072338 dated Jun. 28, 2016.
International Preliminary Report on Patentability Issued in Corresponding PCT Application No. PCT/US2017/064218, dated Jun. 4, 2019.
International Preliminary Report on Patentability Issued in Corresponding PCT Application. No. PCT/US2017/063400, dated May 28, 2019.
International Preliminary Report on Patentability Issued In Corresponding PCT Application No. PCT/US2018/028599, dated Oct. 22, 2019.
International Search Report and Written Opinion in International Application No. PCT/US2014/072338 dated Jun. 2, 2015.
International Search Report and Written Opinion Issued in Corresponding PCT Application No. PCT/US2017/064218, dated Mar. 28, 2018.
International Search Report and Written Opinion Issued in Corresponding PCT Application No. PCT/US2017/063400, dated Feb. 9, 2018.
International Search Report and Written Opinion Issued in Corresponding PCT Application No. PCT/US2018/28599, dated Aug. 1, 2018.
Kadowaki et al., "Development of Soft Power-Assist Glove and Control Based on Human Intent," Journal of Robotics and Mechatronics, vol. 23, No. 2, pp. 281-291, 2011.
Kawasaki et al., "Development of a hand motion assist robot for rehabilitation therapy by patient self-motion control" Presented at Rehabilitation Robotics, 2007. ICORR 2007. IEEE 10$^{th}$ International Conference On. 2007, . DOI: 10.1109/ICORR.2007.4428432.
Lavery, et al., "Shear-Reducing Insoles to Prevent Foot Ulceration in High-Risk Diabetic Patients," *Advances in Skin & Wound Care*, 25(11); 519-524, 2012.
Loureiro and Harwin. "Reach & grasp therapy: Design and control of a 9-DOF robotic neuro-rehabilitation system" Presented at Rehabilitation Robotics, 2007. ICORR 2007. IEEE 10th International Conference on. 2007, . DOI: 10.1109/ICORR.2007.4428510.
Lum et al., "Robotic approaches for rehabilitation of hand function after stroke" American Journal of Physical Medicine & Rehabilitation 91(11), 2012. Available: http://dx.doi.org/10.1097/PHM.0b013e31826bcedb.DOI: 10.1097/PHM.0b013e31826bcedb.
Polygerinos et al., "Soft robotic glove for combined assistance and at-home rehabilitation", Robotics and Autonomous Systems, 73; 135-143, 2015.
Polygerinos et al., "Towards a soft pneumatic glove for hand rehabilitation" Presented at Intelligent Robots and Systems (IROS), 2013 IEEE/RSJ International Conference on. 2013, . DOI: 10.1109/IROS.2013.6696549.
Reiber, et al., "Effect of Therapeutic Footwear on Foot Reulceration in Patients with Diabetes: A Randomized Controlled Trial," *The Journal of the American Medical Association*, 287(19); 2552-2558, 2002.
Sanders, et al., "Clinical Utility of In-Socket Residual Limb Volume Change Measurement: Case Study Results," *Prosthetics and Orthotics International*, 33(4); 378-390, 2009.
Schabowsky et al., "Development and pilot testing of HEXORR: Hand EXOskeleton rehabilitation robot" Journal of NeuroEngineering and Rehabilitation 7(1), pp. 36. 2010. Available: http://www.jneuroengrehab.com/content/7/1/36.
Uccioli, et al., "Manufactured Shoes in the Prevention of Diabetic Foot Ulcers," *Diabetes Care*, 18(10); 1376-1378, 1995.
Ueki et al., "Development of a Hand-Assist Robot With Multi-Degrees-of-Freedom for Rehabilitation Therapy," Mechatronics, IEEE/ASME Transactions on, vol. 17, No. 1, pp. 136-146, 2012.
Ueki et al., "Development of virtual reality exercise of hand motion assist robot for rehabilitation therapy by patient self-motion control" Presented at Engineering in Medicine and Biology Society, 2008. EMBS 2008. 30th Annual International Conference of the IEEE. 2008, . DOI: 10.1109/IEMBS.2008.4650156.
Vermeulen, et al., "Trajectory Planning for the Walking Biped Lucy," *The International Journal of Robotics Research*, 25(9): 867-887, 2006.
Wege & Hommel, "Development and control of a hand exoskeleton for rehabilitation of hand injuries" Human Interaction with Machines, G. Hommel and S. Huanye, Eds. 2006, 149-157, DOI: 10.1007/1-4020-4043-1_16.
Supplementary Search Report and Search Opinion issued for Application No. EP18788515, dated Dec. 22, 2020.

* cited by examiner

PRESSURE MODULATING SOFT ACTUATOR ARRAY DEVICES AND RELATED SYSTEMS AND METHODS

CROSS-REFERENCE TO RELATED APPLICATIONS

This application is a national phase under 35 U.S.C. § 371 of International Application No. PCT/US2018/028599, filed Apr. 20, 2018, which claims the benefit of priority of U.S. Provisional Patent Application No. 62/488,055, filed Apr. 20, 2017, and U.S. Provisional Patent Application No. 62/491,607, filed Apr. 28, 2017, each of the foregoing applications are hereby incorporated by reference in their entirety.

BACKGROUND

1. Field of Invention

The present invention relates generally to cushioning devices, and more specifically, but not by way of limitation, to pressure modulating soft actuator array devices and related systems and methods.

2. Description of Related Art

Pressure ulcers are a serious reoccurring complication among individuals with impaired mobility and sensation. It is postulated that external mechanical loading, specifically on bony prominences, is a major contributing factor in pressure ulcer formation. Strategies to prevent pressure ulcer formation traditionally focus on reducing the magnitude and/or duration of external forces acting upon a person's body. Cushion technologies for reducing pressure ulcer prevalence often employ soft materials and customized cushion geometries. There is a need to improve cushioning technologies to enable customizable devices for each user's condition.

SUMMARY

The present disclosure describes design and controls of an automated cavity array technology that creates a surface for interface pressure/force modulation through redistribution, offloading, and repositioning as well as vibration reduction through dampening. Key features of the present disclosure include: (1) identification of postural and anatomical features of a seated/sleeping person using real-time pressure mapping, (2) offloading and dynamic redistribution of pressure to reduce the duration and magnitude of external mechanical forces on vulnerable areas, (3) minimization of interface pressure buildup and shear loads resulting from offloading and repositioning, (4) reduction of vibration using dampening based on real-time vibration frequency measurements, (5) adaptability to an individual's size, shape, and weight without requiring customized production, (6) recording pressure and vibration history to help define new quantitative metrics for device design and clinical protocols.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

The phrase "and/or" means and or or. To illustrate, A, B, and/or C includes: A alone, B alone, C alone, a combination of A and B, a combination of A and C, a combination of B and C, or a combination of A, B, and C. In other words, "and/or" operates as an inclusive or.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes," one or more steps possesses those one or more steps, but is not limited to possessing only those one or more steps.

Any embodiment of any of the apparatuses, systems, and methods can consist of or consist essentially of—rather than comprise/have/include—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Further, an apparatus or system that is configured in a certain way is configured in at least that way, but it can also be configured in other ways than those specifically described.

Some details associated with the embodiments are described above, and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures. Figures described as schematic are not drawn to scale.

DETAILED DESCRIPTION OF ILLUSTRATIVE EMBODIMENTS

Figure 1:
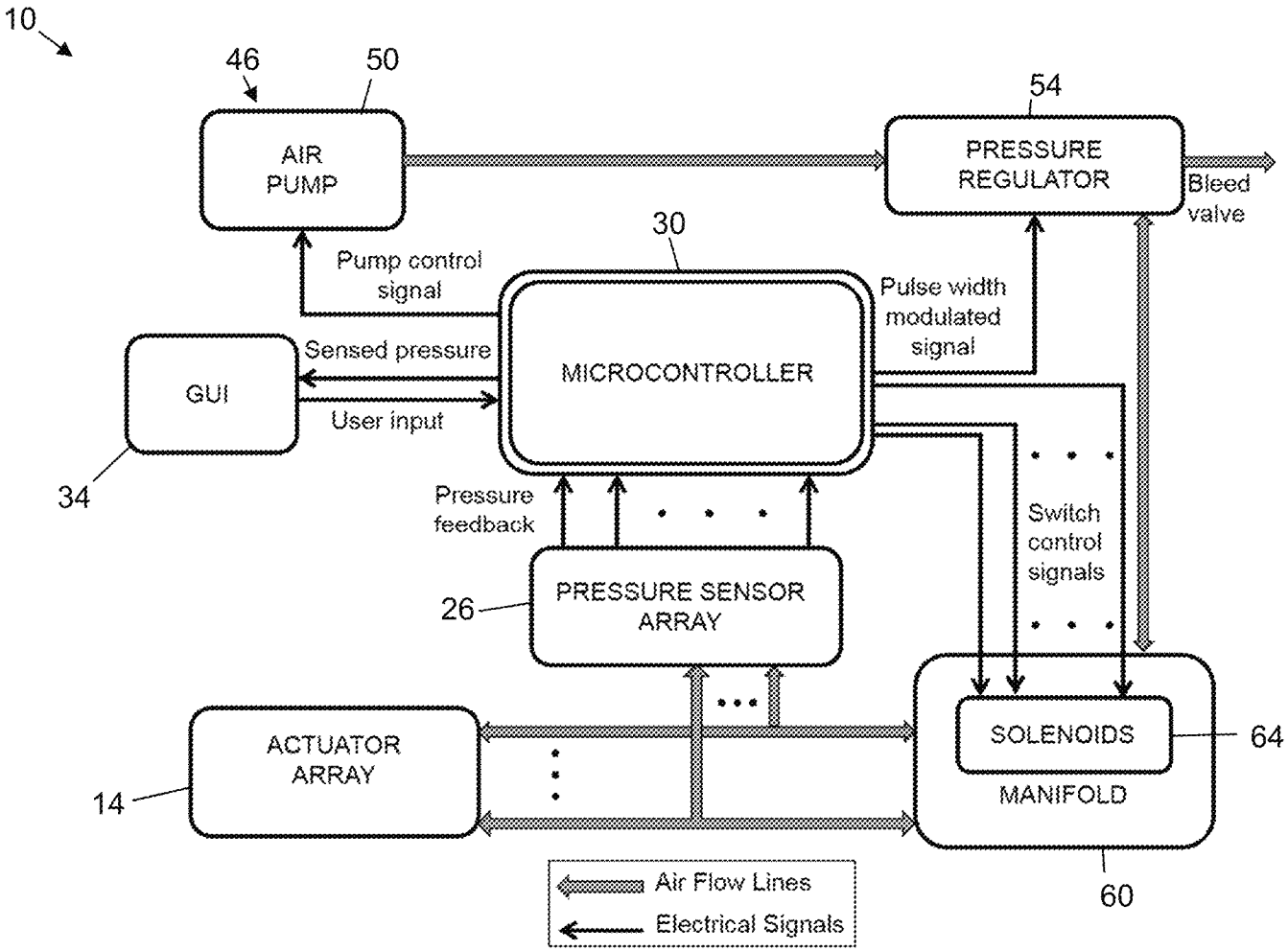
FIG. 1 is a schematic of a first embodiment of the present systems.

Referring now to the figures, and more particularly to FIG. 1, shown therein and designated by the reference numeral 10 is one embodiment of the present systems. System 10 is configured to modulate and/or distribute pressure within a device (e.g., 14) on which a person is disposed upon such that the device prevents the formation and/or propagation of lesions, such as, for example, pressure ulcers. For example, lesions, such as pressure ulcers, can be caused by a prolonged mechanical loading (e.g., due to a person sitting, laying, and/or otherwise being disposed upon a surface, such as, for example, a bed, a chair, and/or the like) and, in at least some instances, can be exacerbated by peripheral neuropathy. Applications of the present systems 10 include, but are not limited to, assistive medical devices, clinical assessment tools, ergonomics products for consumer markets, and/or protective equipment for military personnel. Applications of the present devices 14 include beds, mattresses, mattress overlays, seats, seat cushions, and/or the like.

System 10 includes a device 14 having a body 18 that defines a plurality of cavities 22. Body 18 is configured to be disposed between a person and a surface on which the person is disposed. For example, body 18 can define a seat pad-shaped structure configured to support a person when the person is in an upright position. In some embodiments, a body (e.g., 18) can define an elongated structure configured to support a person when the person is in a reclined position. Body 18 can comprise any suitable material, such as, for example, a flexible polymer (e.g., polyurethane, neoprene, silicone, silicone rubber, and/or the like), a natural rubber, and/or the like. Body 18 can comprise any suitable material that is reinforced with one or more materials, such as, for example, a textile, flexible polymer in optional combination with one or more rigid materials such as a plastic, a metal, and/or any suitable combination thereof.

Figure 2B:
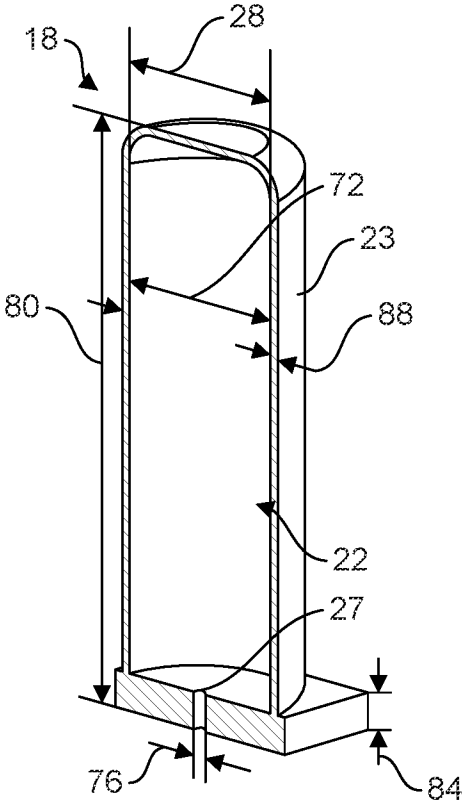
FIG. 2B is a cross-sectional perspective view of the cavity of FIG. 2, taken along line 2B-2B of FIG. 2A.
Figure 2A:
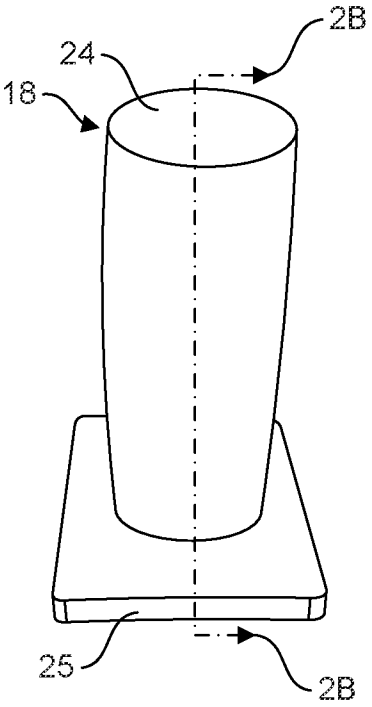
FIG. 2A is a perspective view of a first embodiment of a portion of a body defining a cavity.
Figure 2F:
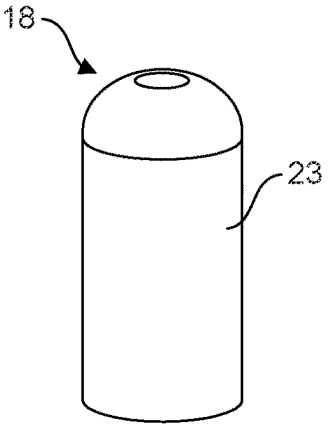
FIGS. 2C-2L show examples of the present bodies and arrangements of the present cavities defined the bodies, which may be suitable for use in some embodiments of the present systems.
Figure 2E:
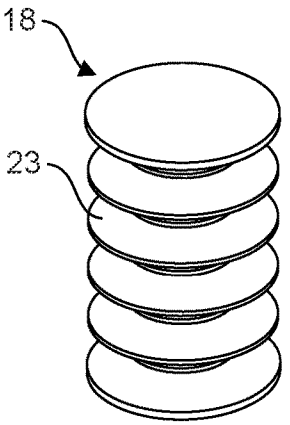
Figure 2D:
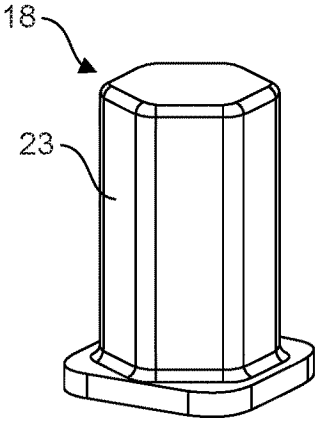
Figure 2C:
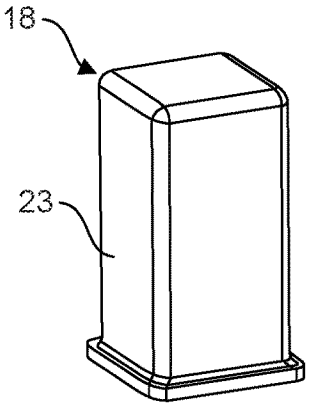
Figure 2G:
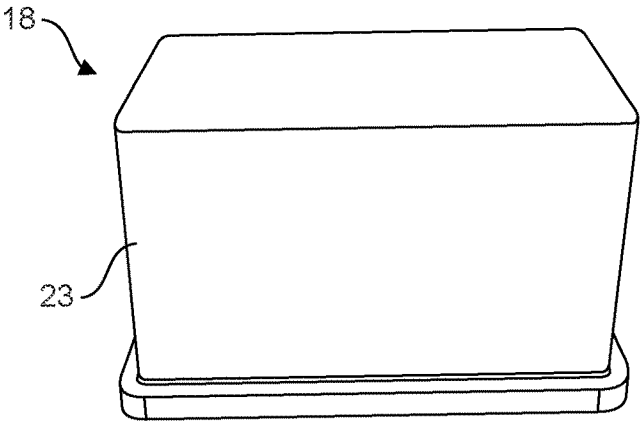
Figure 2H:
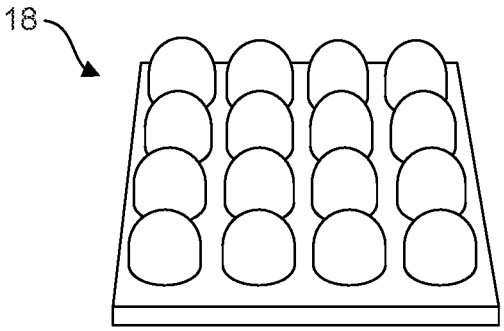
Figure 2I:
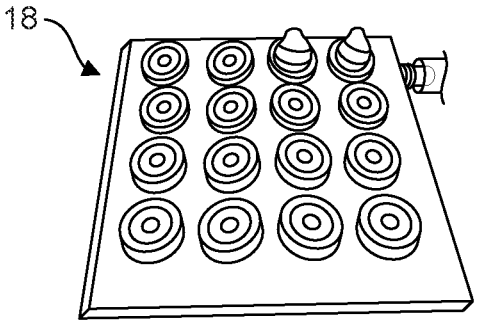
Figure 2J:
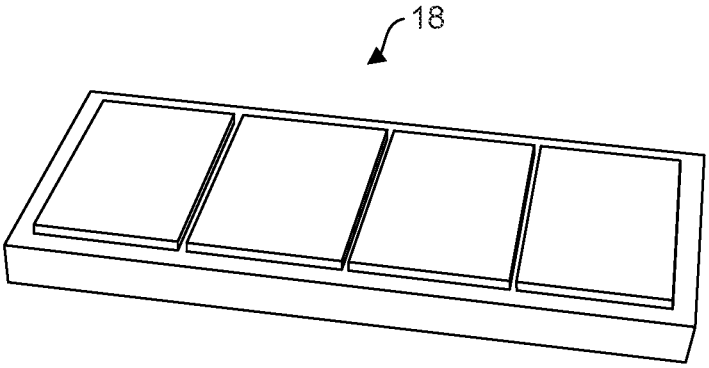
Figure 2K:
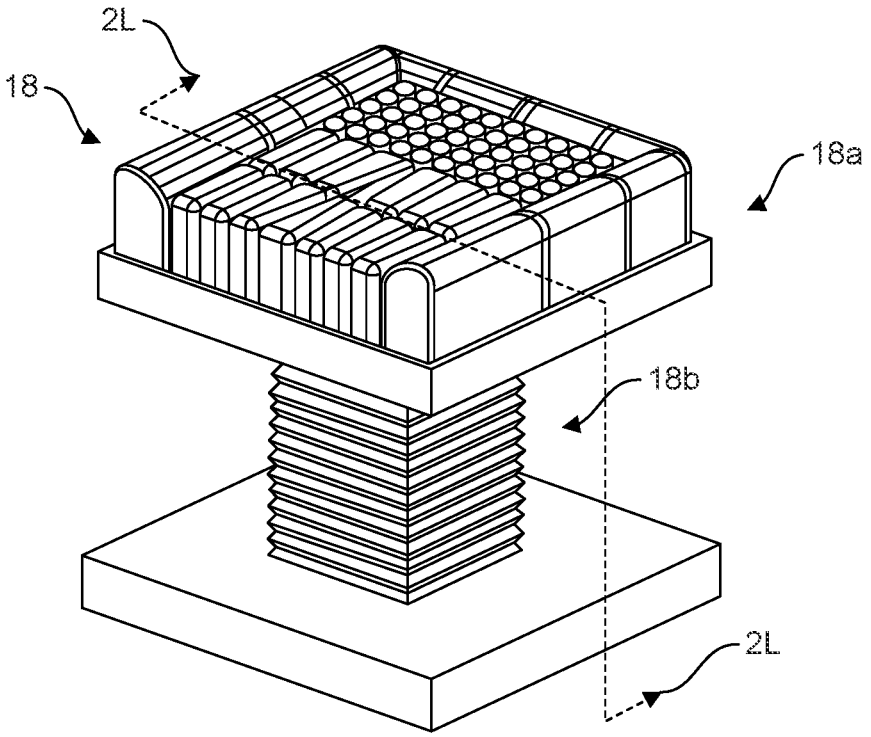
Figure 2L:
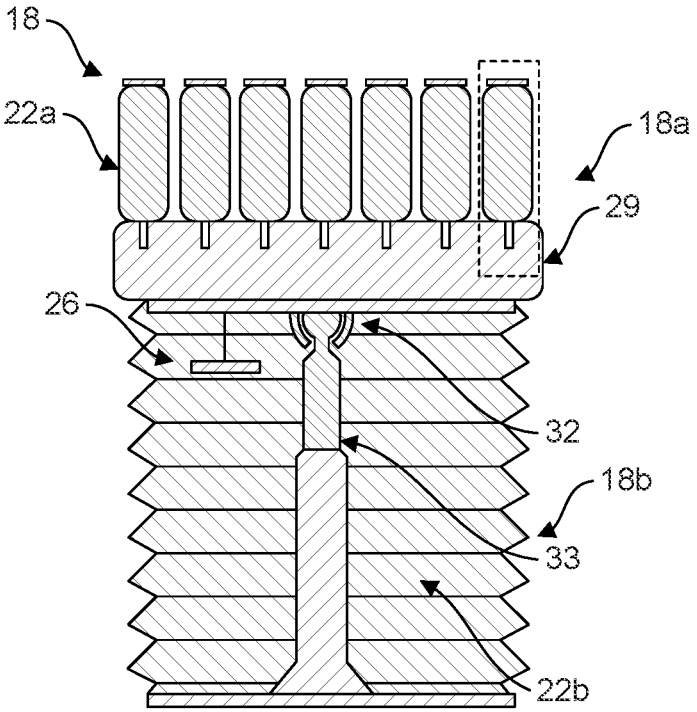

Cavities 22 are arranged on body 18 such that the cavities interface with a (e.g., posterior) portion of a person's body when the person's body is supported by body 18. Cavities 22 can be arranged symmetrically or asymmetrically. Device 14 can have any suitable number of cavities 22, such as, for example, any one of, or between any two of, the following: 2, 3, 4, 5, 6, 7, 8, 9, 10, 12, 14, 16, 18, 20, 30, 40, 50, 60, 70, 80, 90, 100, 110, and 200. FIGS. 2A-2L show examples of bodies (e.g., 18) and arrangements of cavities (e.g., 22) on the bodies. By changing the size and/or the shape of one or more cavities (e.g., 22) and/or arranging them into various configurations, the aforementioned benefits can be achieved. Cavities (e.g., 22) of a body (e.g., 18) can be arranged in two-dimensional planar arrays and/or three-dimensional arrays (e.g., cavities and/or bodies can be stacked on top of each other). Where cavities (e.g., 22) of a body (e.g., 18) are arranged in a three-dimensional array, the cavities at the top will be referred to as "primary cavities" whereas the cavities below the primary cavities will be referred to as "secondary cavities" or further (FIGS. 2K and 2L).

Cavities 22 can be air and/or fluid filled. Each cavity 22 can be defined by sidewall 23 bound together by top and bottom layers 24, 25 as well as a channel 27 to supply or relieve air and/or fluid pressure. Cavities 22 can be prefabricated with standard sizes and/or cross-sectional shapes. For example, one or more of cavities 22 can include any suitable cross-sectional shape, such as, for example, triangular, rectangular, square (e.g., FIG. 2C), hexagonal (e.g., FIG. 2D), or otherwise polygonal, circular (e.g., FIGS. 2E and 2F), elliptical, or otherwise rounded. A top layer 24 of body 18 defining one or more cavities 22 can be planar, domed shape, corrugated, and/or any combination thereof. Sidewall 23 defining one or more cavities 22 can be planar (e.g., FIGS. 2C and 2D), corrugated, bellowed (e.g., FIG. 2E), curved (e.g., FIG. 2F) and/or any combination thereof. Each cavity 22 can comprise a height 80 ranging from 2 to 50 centimeters (cm). Each cavity 22 can comprise a width 28 ranging from 2 to 50 cm. Each of top layer 24, bottom layer 25, and sidewall 23 can have a thickness 88 ranging from 1 millimeter (mm) to 25 mm.

Referring specifically to FIGS. 2K and 2L, shown therein one configuration of device 14 that can be used to create pressure modulation and vibration reduction. Device 14 may include an integration platform 29 which houses pneumatic and/or fluidic lines. Device 14 may include a coupling mechanism 32 configured to allow integration platform 29 to pivot. Device 14 may include a concentric tube assembly 33 having one or more telescoping tubes configured to support linear translation along a vertical axis. Depending on the intended use for device 14 (e.g., as a seat-cushion, as a bed-cushion, and/or the like), one or more of these components can be configured and assembled for the required functionality.

One or more of cavities 22 can be configured to be modulated by increasing and/or decreasing an internal pressure within the one or more cavities such that device 14 reduces and/or increases mechanical loading on portions of a person's body. In at least this way, device 14 prevents prolonged exposure to mechanical stresses, which can result in pressure ulcers. Further, in this way and others, device 14 can conform to a person's body to decrease the interface stress and increase contact area to provide better a fit and comfortability.

System 10 can include one or more sensors 26 configured to capture data indicative of a pressure within one or more cavities 22. For example, at least one of one or more sensors 26 may include a pressure sensor (e.g., a MEMS pressure sensor, piezoelectric pressure sensor, strain gauge, and/or the like). Cooperation between body 18 and one or more sensors 26 allows for real-time pressure mapping of and/or pressure control within respective cavities for interface force and vibration modulation.

Figure 3:
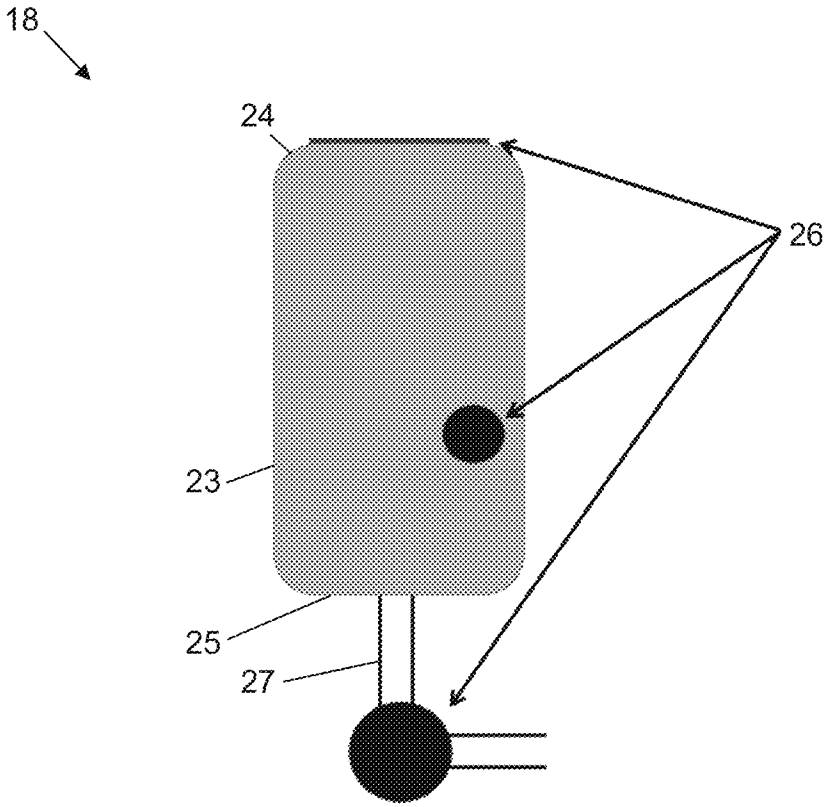
FIG. 3 is a schematic view of the placement of sensors on a portion of a body defining a cavity, which may be suitable for use in some embodiments of the present systems.

Referring now to FIG. 3, shown is a schematic of locations on body 18 where one or more sensors 26 may be disposed. As shown, one or more sensors 26 can be coupled to or disposed within sidewall 23, top layer 24, and/or bottom layer 25 of body 18 that defines cavity 22. One or more sensors 26 can be disposed within cavity 22 and/or within channel 27.

Figure 4A:
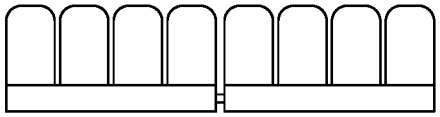
FIGS. 4A-4F show examples of the present bodies and arrangements of the present cavities defined the bodies, which may be suitable for use in some embodiments of the present systems.
Figure 4D:
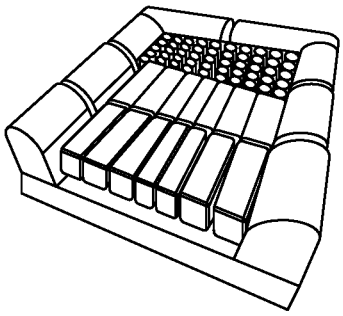
Figure 4B:
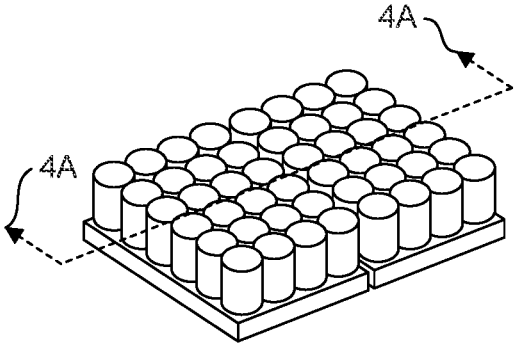
Figure 4E:
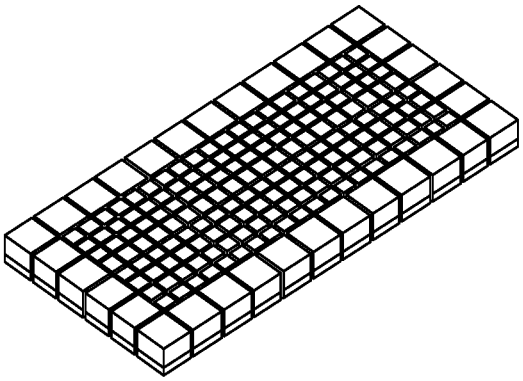
Figure 4C:
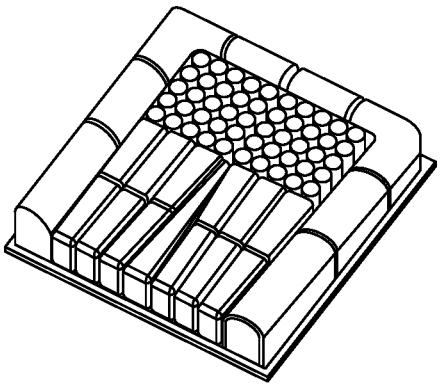
Figure 4F:
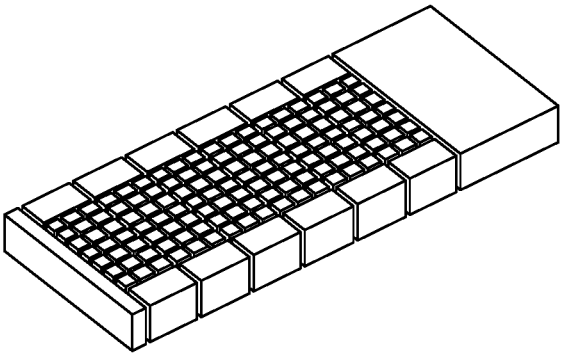

Referring now to FIGS. 4A-F, shown therein are various embodiments of body 18 of device 14 for pressure modulation. FIGS. 4A-D depict device 14 as a seat cushion, head support, foot support, and/or the like. FIGS. 4E and 4F depict device 14 as a mattress cushion or mattress overlay. FIG. 4A shows a cross section of FIG. 4B taken along line 4A-4A. Each device 14 shown in FIGS. 4A-F includes one or more sensors 26 coupled to body 18 having cavities 22, which are disposed on fluidic channel routing platform 29. The shape, size, and placement of cavities 22 can be varied based on the application scenario such as comfort, medical need, and/or the intended use of device 14. For example, for seat cushion and mattress applications, pressure, shear, temperature, and moisture sensors can be integrated for control and monitoring purposes. One example of a seat cushion device 14 for pressure ulcer prevention is shown in FIG. 4C (e.g., a three-dimensional rendering) and FIG. 4D (e.g., a fabricated prototype). FIGS. 4E and 4F show first and second conceptual designs for a mattress or mattress overlay device 14. As shown, the mattress or mattress overlay device 14 includes a body 18 having cavities 22 with various sizes and shapes strategically placed to provide pressure redistribution and offloading for pressure ulcer prevention purposes. For instance, a dense area with smaller cavities 22 are placed in areas where a person's sit bones and/or tail bone comes into contact while seating. In some embodiments, a body (e.g., 18) may include a (e.g., a soft and/or rigid) foam surrounding at least a portion of cavities (e.g., 22).

Referring again to FIGS. 2K and 2L, shown therein is an example a body 18 of a device 14 for pressure modulation and vibration reduction. FIG. 2K is a three-dimensional rendering of device 14 and FIG. 2L is a cross-section of the device shown in FIG. 2K taken along line 2L of FIG. 2K. In this embodiment, device 14 is configured for use as a seat cushion. Device 14 comprises a first body 18*a* having cavities 22 (i.e., a "primary cavities") and one or more sensors 26, a second body 18*b* having cavities 22 (i.e., a "secondary cavities") and one or more sensors 26, fluid channel integration platform 29, coupling mechanism 32 (e.g., for pivoting), and a concentric tube assembly 33 (e.g., for guiding linear movement of the primary cavities and/or the secondary cavities along a vertical axis). In this embodiment, primary cavities 22*a* functions as described above. Secondary cavities 22*b* are configured to aid in vibration reduction by changing an internal pressure within one or more of the secondary cavities and/or adjusting an overall vertical height of device 14. One or more sensors 26 configured to control secondary cavities 22*b* can include sensors configured to collect data indicative of vibration, acceleration, and/or pressure. As shown, coupling mechanism 32 can be disposed where secondary cavities 22*b* are coupled to fluid channel integration platform 29. In some embodiments, a coupling mechanism (e.g., 32) can be disposed at a base of a device (e.g., 14). In this embodiment, the shape, size, and/or placement of one or more of primary cavities 22*a* can be varied based on the application scenario. Similarly, the geometry and/or operation of one or more secondary cavities 22*b* can vary widely based on the intended use of device 14. For example, for devices 14 used in vehicles, the geometry and/or operation of one or more primary cavities 22*a* and/or secondary cavities 22*b* may vary based on vehicle type, driving terrain, speed, and/or the like.

Figure 5A:
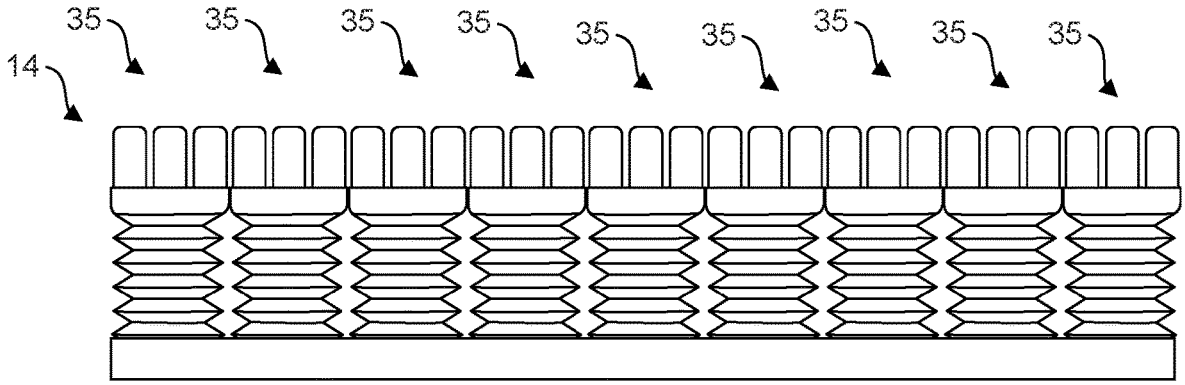
FIGS. 5A and 5B show a side cross-sectional view and a perspective view, respectively, of one example of a device, which may be suitable for use in some embodiments of the present systems.
Figure 5B:
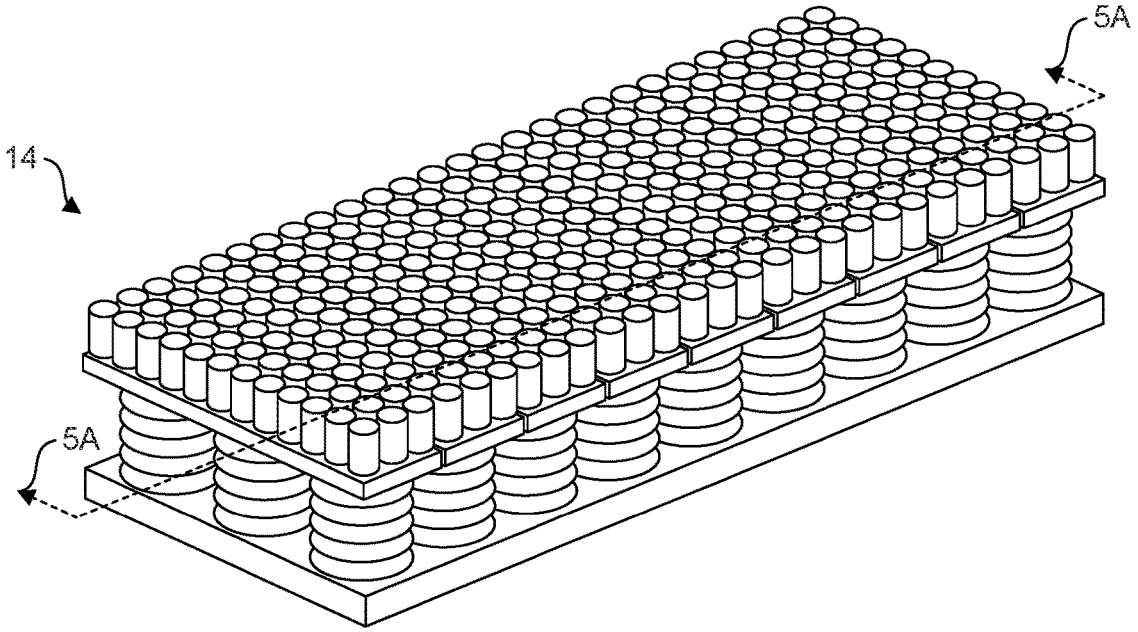

Referring now to FIGS. 5A and 5B, shown therein is another example of device 14. In this embodiment, device 14 is configured for use as a bed for pressure modulation and repositioning. Device 14 can include a body 18 having a plurality of segments 35 arranged in a wide array which can support a person's entire body. Each segment 35 is connected to an adjacent segment 35 by, for example, a hinge joint, a ball socket joint, and/or the like. In some embodiments, flexible polymeric and/or metal structures serve as joints to couple adjacent segments (e.g., 35) of a body (e.g., 18). Device 14 includes primary cavities 22*a*, one or more of which implement pressure modulation and/and off-loading. Device 14 includes secondary cavities 22*b*, one or more of which implement repositioning and/or shifting of the body weight to different areas.

Figure 6A:
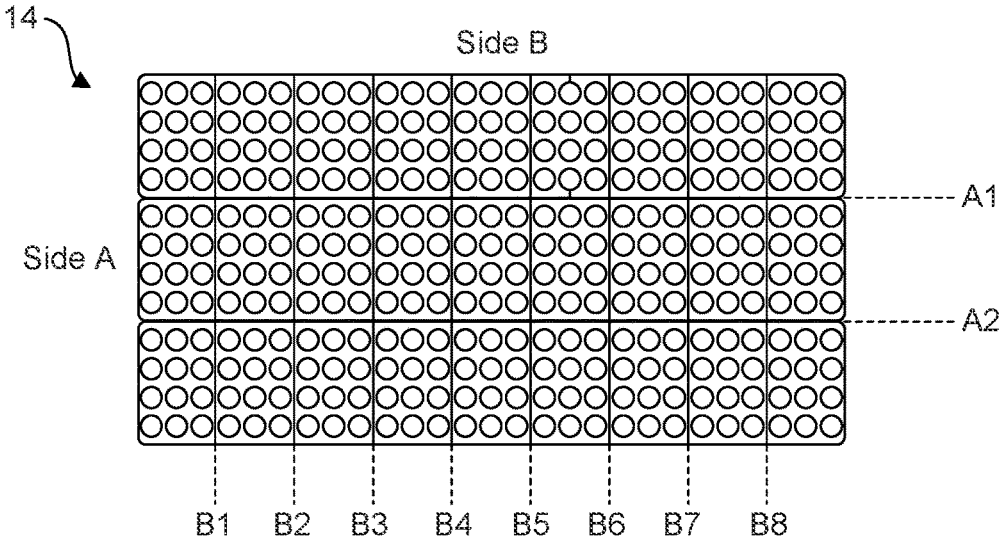
FIGS. 6A-6C show a top view, a first side view, and a second side view, respectively, of the device of FIGS. 5A and 5B.
Figure 6B:
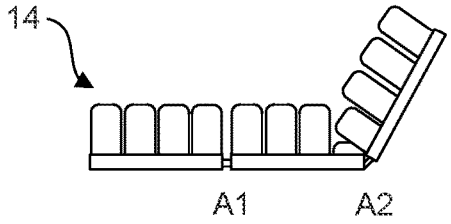
Figure 6C:
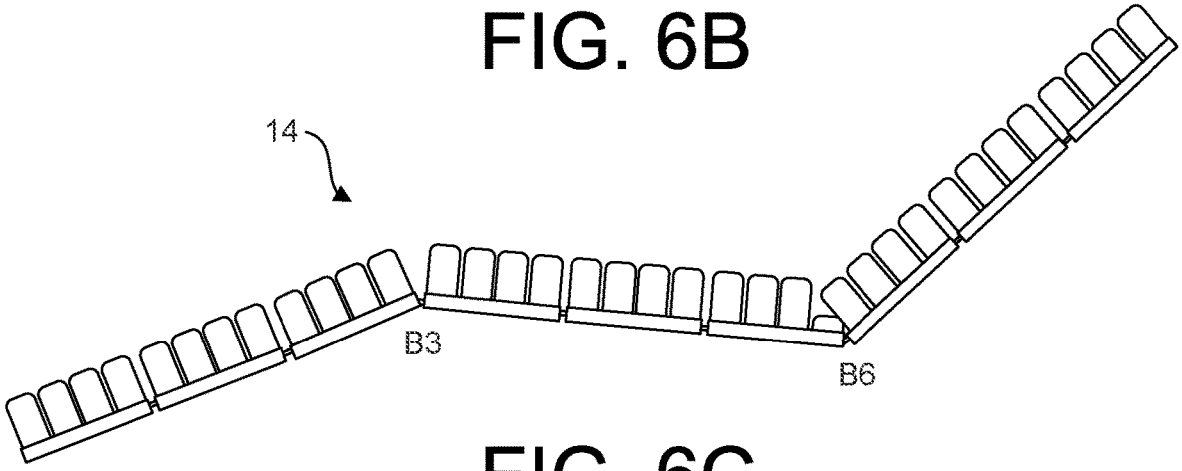

FIGS. 6A-6C show the axes of rotation for segments 35 of device 14. For example, device 14 is capable of rotation about an A1 axis and an A2 axis, each of which can be utilized for rolling and/or repositioning an individual laying on the device. FIG. 6B shows an example of segment 35 rotation around the A2 axis. Rotation around a B axis (e.g., B1-B8 axis) can be used to change an elevation of the legs, head, and/or upper body sections of a person, as shown in FIG. 6C. Based at least upon a degree of rotation at these axes (e.g., any one of A1-A2 axes and/or B1-B8 axes), operational algorithms will deflate and/or inflate individual cavities 22 along an edge of this axis(es) to accommodate for the new position, as can be seen in FIGS. 6B and 6C.

In this embodiment, system 10 can be a pneumatic-based control system with an associated control algorithm for controlling a device (e.g., 14). System 10 includes electrical and pneumatic components including a pump 50, (e.g., solenoid) valves 64, an (e.g., air) manifold 60, one or more sensors 26, a pressure regulator 54, pneumatic conduits, one or more controllers 30, a graphical user interface (GUI) 34, and a power supply.

System 10 includes one or more controllers 30 (e.g., one or more microcontrollers) configured to control the modulation of cavities 22. In this embodiment, one or more controllers 30 can be configured to receive commands from a GUI 34. For example, GUI 34 can be configured to receive user input, which can toggle and/or define a manual and/or automated modulation of one or more of cavities 22. For example, GUI 34 can display data indicative of pressure within one or more cavities 22 and, after receiving a user input, the GUI can send commands to one or more controllers 30 for modulating pressure within the cavities. GUI 34 may be coded in any suitable programming language, such as, for example, MATLAB, Visual Studio, LabVIEW, and/or the like. GUI 34 can be configured to display a real time pressure profile and enable user inputs for selective offloading, redistribution, and repositioning for pressure modulation as well as vibration reductions. GUI 34 can be displayed on any suitable device, such as, for example, a desktop computer, a mobile and/or handheld device (e.g., a laptop, tablet, phone, and/or the like), and/or the like. The control algorithms used with system 10, which can run from either GUI 34 and/or one or more controllers 30, can identify anatomical features using the pressure profile created from sensor data and command the control hardware to operate the actuators in an automated manner (discussed in further detail below).

Figure 7:
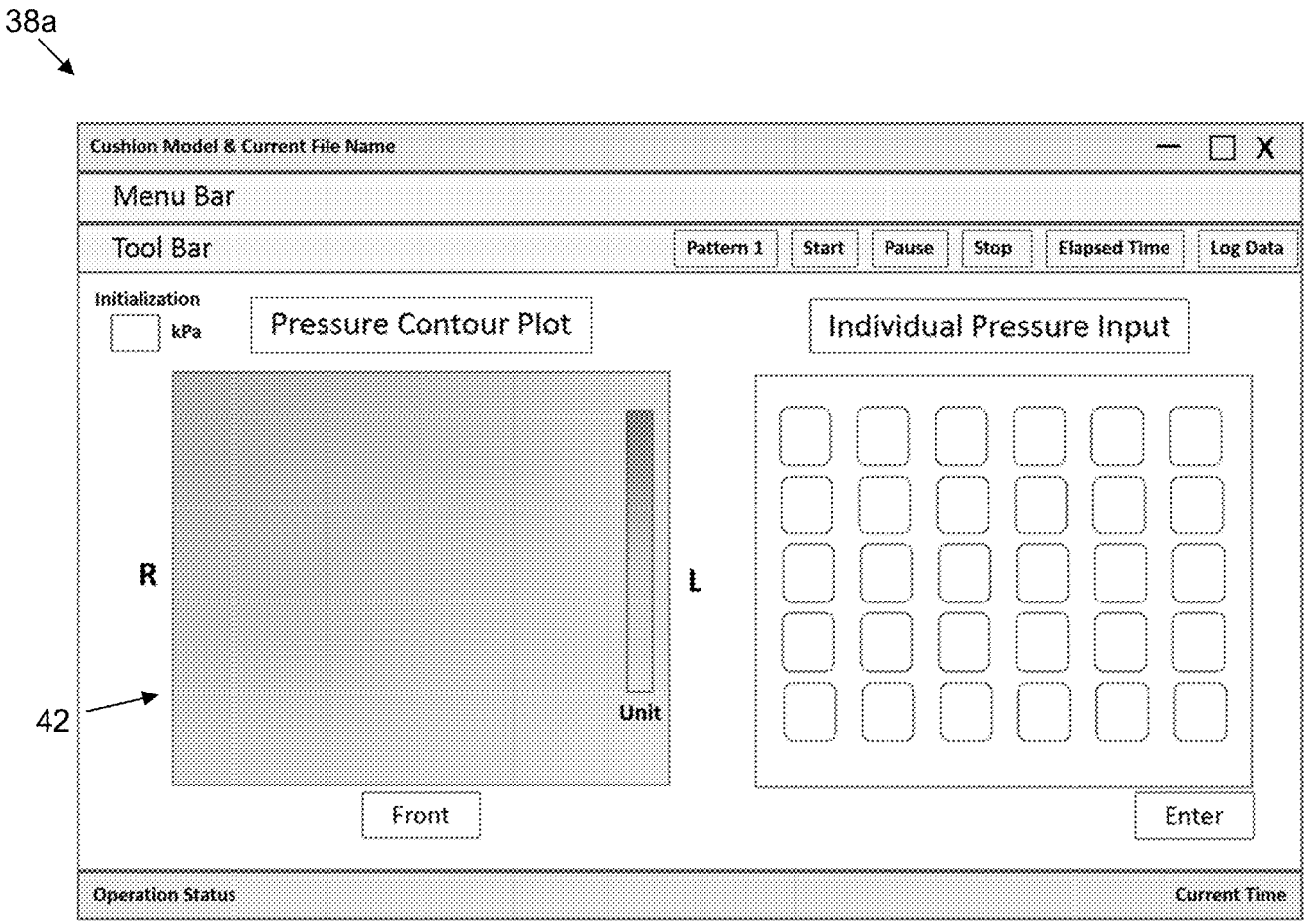
FIG. 7 is a first screenshot of a sample interface of a graphical user interface (GUI) that may be suitable for use in some embodiments of the present systems.
Figure 10:
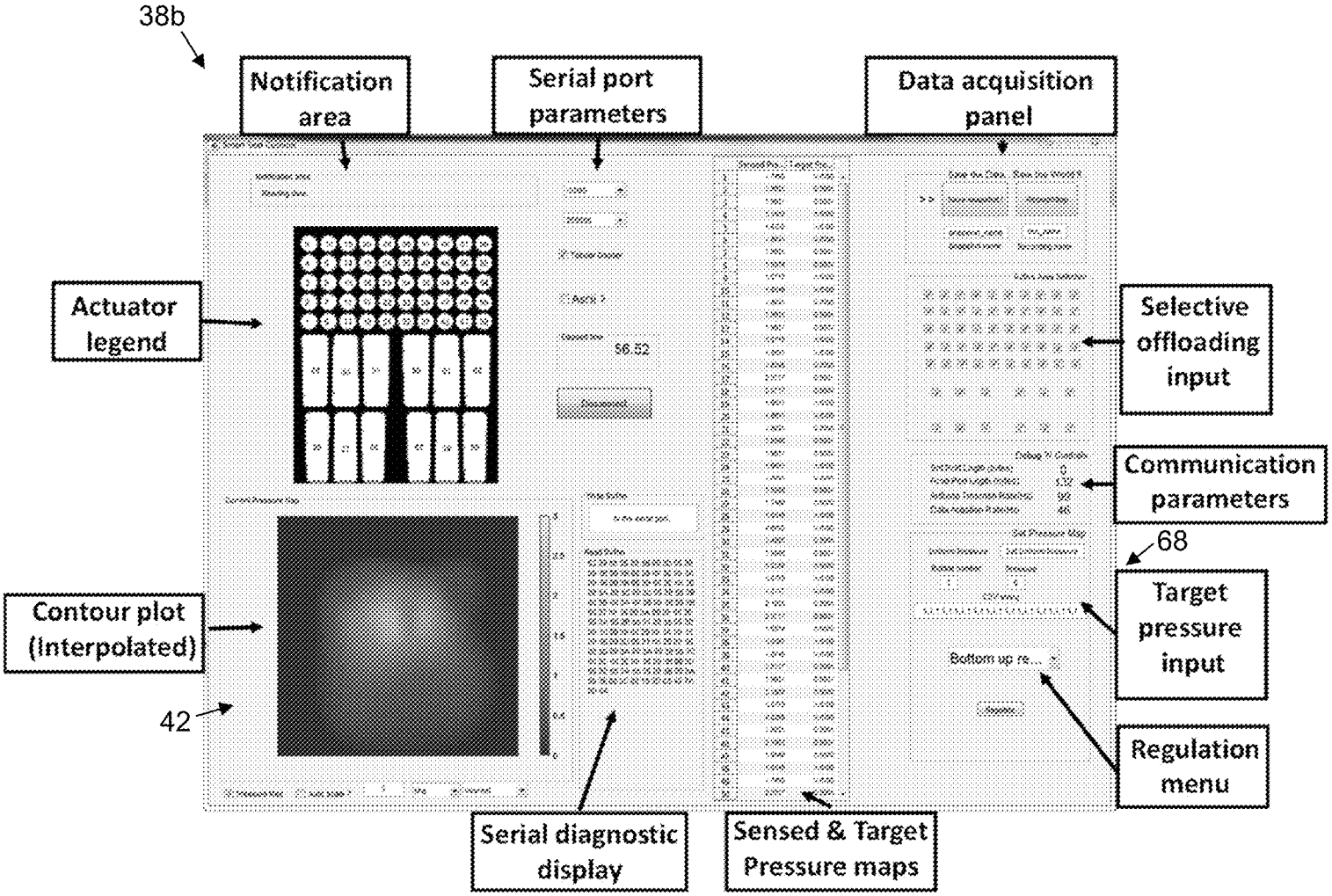
FIG. 10 is a second screenshot of a sample interface of a graphical user interface (GUI) that may be suitable for use in some embodiments of the present systems.

Referring to FIGS. 7 and 10, shown therein and designated by the reference numeral 38*a* and 38*b* is a respective first and second sample interface of GUI 34. In this embodiment, GUI 34 is configured to provide a visualization of a sensed pressure profile 42 of one or more cavities 22. Pressure profile 42 can be plotted using raw data from sensors 26 and/or interpolated data using different interpolation techniques. Pressure profile 42 can display data in a two-dimensional or three-dimensional frame. Pressure profile 42 can (e.g., also) display historical data recorded during a period of time in a two- and/or three-dimensional plot or a video format. Sensed pressure profile 42 can provide a visualization representation of a location and/or magnitude of pressure as sensed by one or more sensors (e.g., 26) (described in further detail below).

GUI 34 can provide a visualization of the status of device 14 and allow users to manipulate the device. For example, GUI 34 may be configured to allow a user to modulate pressure within one or more of cavities 22 to increase and/or decrease an internal pressure within one or more cavities 22 such that device 14 increases and/or decreases mechanical loading on portions of a person's body. By increasing and/or decreasing an internal pressure within one or more cavities 22, device 14 increases and/or decreases the contact area, immersion, and envelopment of the body to the device. GUI 34 can be configured to provide an interface to input a desired pressure profile to an outer loop of one or more controllers 30 (discussed in further detail below). GUI 34 can display the most current pressure profile from the sensor data of device 14 regardless of the operation status. GUI 34 can display pressure profile at a selected time stamp point. GUI 34 can play the recorded pressure data in a video format. An array of selection boxes is located next to the pressure profile display for the purpose of manipulating selective actuators. The cushion model and/or current file name can be displayed at the top of GUI 34, as well as the control to the GUI window, such as minimizing, closing, and enlarging. The menu bar located underneath the current name file includes a group of function buttons and each has a drop-down menus. The "File" button can be designed for file viewing, archiving, naming/renaming, importing, printing, data exporting, and other file manipulation. It also allows to start, stop, and pause the sensor data recording. The "Edit" button can be designed for any general file, picture, clip, video, text editing, including, copy, paste, cut, load and other file editing functions. The "View" button can be designed for pressure profile visualization which can be displayed in different format by different data interpolation technique, such as 2-D and 3-D pressure profile plot. It also includes the functions that can identify the peak at a given area and during a given time period, average the pressure at a given area and during a given time period, and the view option of the GUI window, such as show and hide certain GUI component, zoom in and zoom out, and/or the like. The "Analysis" button can offer the function for user to view and analyze the pressure data of individual actuator or actuators are within the user defined area in different shapes by drawing the boundary. The "Option" button can help users to view the device setting information, including the hardware setting, software setting, and the sensor setting information, unit setting, current file display information, initial pressure setting for all actuators, etc. The "Adjust" button allows user to select different pressure modulation scheme, such as pressure redistribution over all actuators (Global adjustment), local (within a given area) pressure redistribution, pressure offloading within the predefined areas, predefined pressure patterns. The "Tools" button is designed for user to calibrate all the sensor and save the calibrating file. The "Window" button offers the options to manage the icons, colors, orientation, and the tool bar. The "Help" button provides the information of the device, user manual, technical support, and searching functionally. The tool bar located underneath the menu display the icons of some major and common functions, such as data log, start, pause, stop recording, predefined pressure patterns, probe for finding peak pressure, quick plot, elapsed time, etc. The bottom of the GUI display the operation status, such as, ready, in use, offline, the current time, and/or the like. GUI can provide an interface to input desired pressure profile to the outer loop of the control architecture.

GUI 34 may allow a user to manually modulate pressure within one or more of cavities 22 by, for example, allowing the user to input a desired internal pressure for one or more of the cavities. GUI 34 may (e.g., also) allow a user to enable an algorithm-based operation (e.g., executed by one or more controllers 30) (described in further detail below) to modulate pressure within one or more of cavities 22. Such an algorithm can be configured to automatically synthesize a desired pressure profile based at least upon a sensed pressure within one or more of cavities 22. For example, such an algorithm can include any suitable algorithm configured to reduce an error between a sensed pressure profile and a desired pressure profile, such as, for example, a sliding mode control algorithm. To illustrate, one or more controllers 30 can be configured to receive sensed data from one or more sensors 26 indicative of a pressure within one or more cavities 22. When one or more controllers 30 receive such sensed data from one or more sensors 26, the one or more controllers can be configured to compare the sensed data to a desired internal pressure (e.g., selected manually and/or calculated by an algorithm-based operation). Based on the comparison between the sensed data and the desired internal pressure, one or more controllers 30 can transmit one or more signals to one or more of a pressure source (e.g., 46) (e.g., pump 50), a pressure regulator (e.g., 54), and/or a pneumatic manifold (e.g., 60) (e.g., comprising one or more valves 64) to achieve the desired internal pressure within one or more of cavities 22.

Figure 8A:
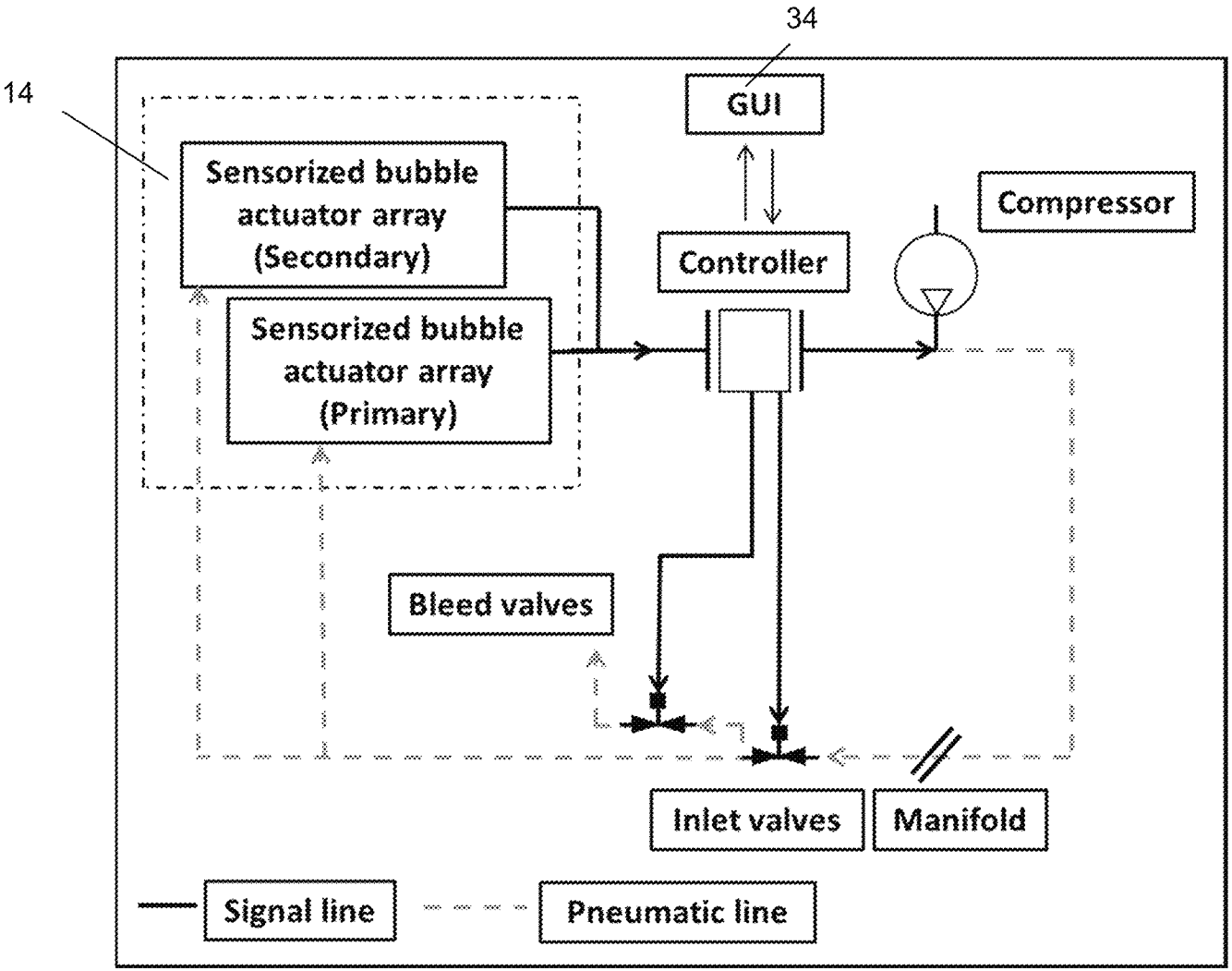
FIG. 8A is a schematic of a second embodiment of the present systems.
Figure 8B:
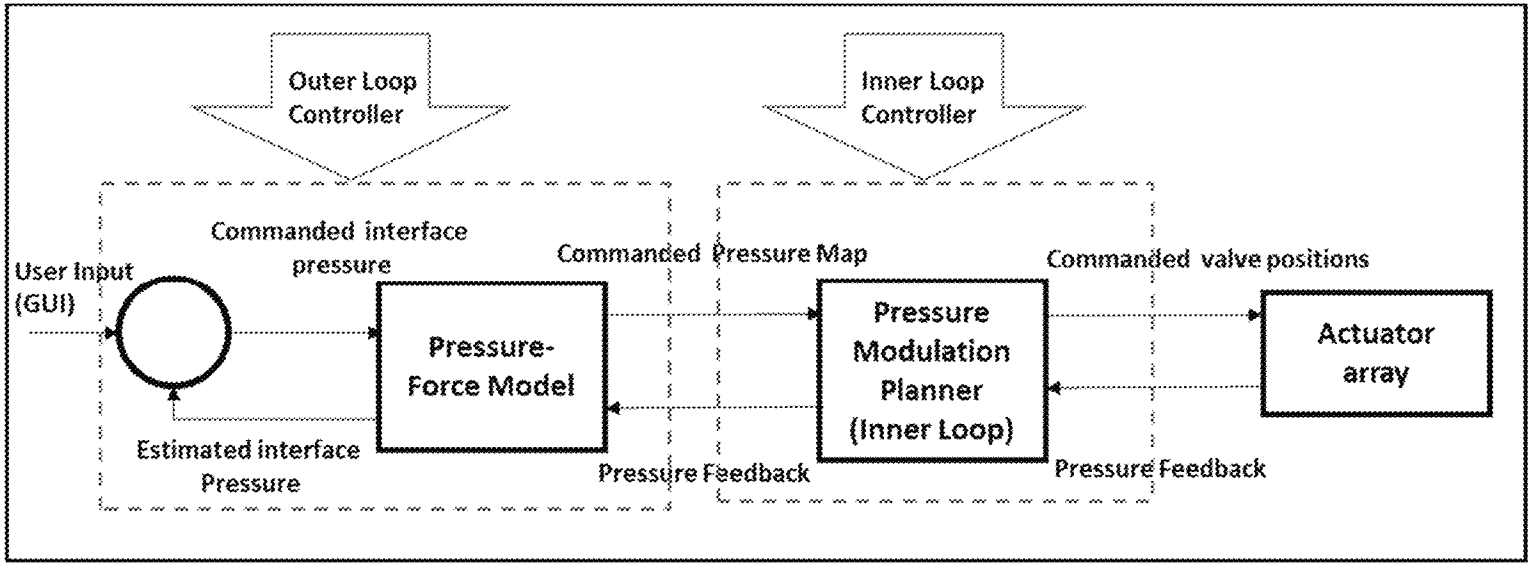
FIG. 8B is a schematic of a control protocol suitable for execution by the present systems.
Figure 9:
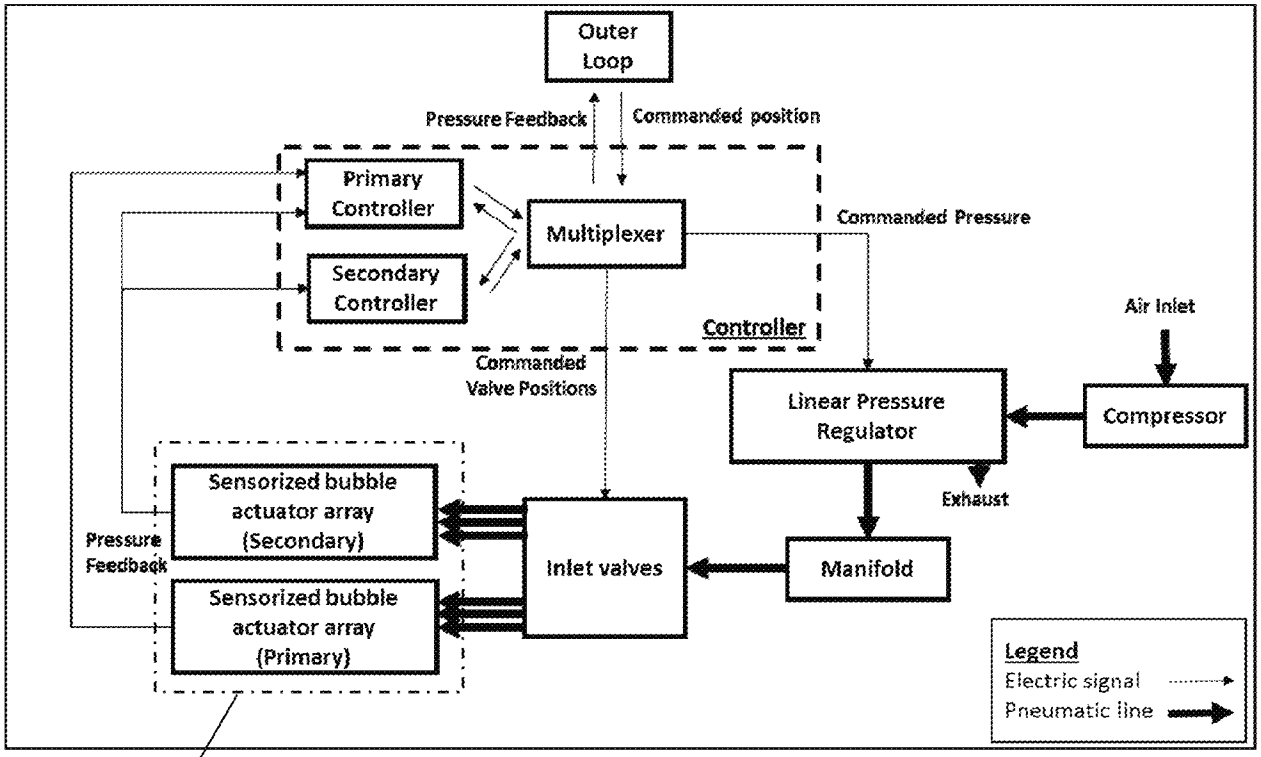
FIG. 9 is a schematic of a pressure modulation planner and controller, which may be suitable for use in some embodiments of the present systems.

Referring now to FIGS. 8A, 8B and 9, automation of the modulation of cavities 22 is discussed. For example, to automatically modulate pressure within one or more cavities 22, one or more controllers 30 may receive a control task, which may be broken into two steps: inner loop and outer loop (e.g., FIG. 9). A schematic of the control task is shown in FIG. 8B. Decoupling of the control task into inner and outer loops provides standalone performance guarantees in absence of the outer loop and flexibility for implementing the outer loop on various platforms (e.g., Windows, Linux, Mac, Android, iOS). Similarly, the inner loop can be implemented on any other embedded computing platform. The inner loop can be implemented with control hardware comprising one or more controllers (e.g., 30), valves (e.g., 64), a pressure regulator (e.g., 54), pressure sensors (e.g., 26), a manifold (e.g., 60), fluidic or air pump (e.g., 50), and an AC to DC converter.

The inner loop algorithm is implemented on an embedded platform like one or more controllers 30 and can be responsible for monitoring pressure values as well as operating valves 64 and proportional air regulator 54 to maintain a given target pressure map. One or more controllers 30 can transmit the current pressure map to the outer loop for display and receive the target pressure map for inner loop control. The outer loop running on a computational platform can run the algorithm to synthesize a target pressure map from the current pressure map provided by the inner loop. GUI 34 can display the received pressure map as well as transmits a target pressure map.

The inner loop control unit (FIG. 8B) enables sensor data transfer, pressure mapping, and/or pressure modulation based on a control algorithm and user input. The control unit can be built using commercially-available hardware including solenoid valves (e.g., 64), manifolds (e.g., 60), a pump (e.g., 50), and one or more controllers (e.g., 30). The inner loop controller aims to diminish the tracking error between a sensed pressure map and the given commanded pressure map. A pressure map from the sensorized cavities 22 can serve as measured outputs. Based on measured output and commanded pressure map from the outer loop, control inputs can be generated. Control inputs include commanded pressure for pressure regulator 54 and commanded pneumatic valve positions.

Pressure regulator 54 can be a commercially available electromechanical device which regulates the pressure of manifold 60 to a given commanded pressure. Inlet valves 64 can be two-position electromechanical switches which pneumatically connect an individual cavity 22 to manifold 60 when the valve is turned on. Each inlet valve 64 can keep an individual cavity 22 pneumatically closed when the valve is turned off. Although only one pressure regulator 54 is shown in FIGS. 1 and 9, multiple regulators can be used for increased control authority. The internal pressure of each cavity 22 (e.g., primary and/or secondary) is read by a pressure sensor 26 as a controller feedback. Pressure mapping also can be implemented for feedback control.

In some embodiments, the inner loop controller is further divided into two separate parts for controlling primary and secondary cavities 22 separately. This demarcation helps identifying controller parameters separately for each set of cavities 22 (e.g., primary and secondary). Further, the layout of cavities 22 can ensure that the position of the secondary cavities can affect the pressures of the primary cavities where device 14 interfaces with a person. A primary controller (e.g., 30*a*) can incorporate a compensation term based on the feedback from secondary cavity 22 position. A multiplexer can combine the commanded valve positions and commanded pressures from both primary and secondary controllers 30*a* and 30*b* and schedule the combined control inputs for the whole system 10. The inner loop controller 31*a* as a whole keeps changing the combined control inputs until the commanded pressure map from the outer loop is tracked for both primary and secondary cavities 22.

The commanded pressure map for the inner loop can be synthesized by the outer loop based on user input (e.g., internal pressure, interface pressure, and/or pressure profile) and/or an estimate from a Pressure-Force Model. A model-based force control algorithm can provide predictions of the dynamic behavior of cavities 22 and can facilitate the adjustment of the cavities' internal pressure to achieve a desired pressure and shear distribution across an upper surface of body 18. The proposed control algorithm guarantees that cavities 22 will maintain the desired magnitude and direction of interacting forces through internal pressure modulation.

The outer loop can be configured to identify anatomical features based on a pressure profile (e.g., internal pressures of cavities 22), recognize vulnerable areas, and/or plan pressure relief strategies. The planning algorithms can be configured to reduce tissue distortion due to the magnitude, direction, and gradient of pressure and/or shear forces. By implementing vibration sensor data as measured input, stiffness of cavities 22 can be change to reduce vibration.

As shown, system 10 may include a pressure source 46. Pressure source 46 may be configured to provide fluid to one or more of cavities 22 such that pressure within the one or more of the cavities can be varied. For example, pressure source 46 can include a pump 50 that is in fluid communication with one or more cavities 22 via one or more conduits (e.g., pneumatic, hydraulic, electronic, and/or the like). In this embodiment, pressure source 46 can be controlled by one or more controllers 30. For example, one or more controllers 30 may be configured to transmit a fluid control signal (e.g., a binary signal) to pressure source 46 (e.g., via one or more conduits and/or wirelessly) to control fluid flow from pressure source 46. For example, pressure source 46 can include a pump and a fluid reservoir which will provide fluid to one or more of cavities 22.

In this embodiment, system 10 can include a (e.g., linear) pressure regulator 54 configured to regulate fluid pressure within a pneumatic manifold (e.g., 60) in response to a desired pressure profile (e.g., 68) requested by one or more controllers (e.g., 30) (discussed in further detail below). For example, pump 50 can be configured to direct fluid into pressure regulator 54 such that the pressure regulator can regulate pressure within one or more cavities 22 via the pneumatic manifold (e.g., 60). In this embodiment, pressure regulator 54 can be controlled by one or more controllers 30. For example, one or more controllers 30 may be configured to transmit a pressure regulation signal (e.g., a pulse-width modulation signal and/or the like) to pressure regulator 54 (e.g., via one or more conduits and/or wirelessly) to control fluid flow from pressure source 46.

As shown, system 10 can include a pneumatic manifold 60 having one or more valves 64 (e.g., a solenoid valve and/or the like that can comprise any suitable configuration, such as, for example, two-port two-way (2P2 W), 2P3 W, 2P4 W, 3P4 W, and can be actuatable in any suitable manner, such as, for example, by one or more solenoids) configured to selectively direct fluid to and/or away from one or more of cavities 22.

In this embodiment, one or more valves 64 of manifold 60 can be in fluid communication with a respective one of one or more cavities 22. In some embodiments, one or more valves (e.g., 64) of a manifold (e.g., 60) can be in fluid communication with two or more cavities (e.g., 22). Fluid within one or more of cavities 22 may comprise hydraulic fluid (liquid), pneumatic fluid (gas), and/or the like.

Manifold 60 can supply each solenoid via individual air outlets with a regulated pressure (e.g., from pressure regulator 54 and/or pressure source 46). When one or more of valves 64 is opened, the valve will expose its associated cavity (e.g., 22) with a supplied air pressure, thereby increasing or decreasing the pressure within the cavity depending on its initial value. Similarly, when one or more of valves 64 is closed, the valve can seal the resulting pressure within its associated cavity 22. In this embodiment, manifold 60 can be controlled by one or more controllers 30. For example, one or more controllers 30 may be configured to transmit a switch control signal (e.g., a binary signal) to manifold 60 (e.g., via one or more conduits and/or wirelessly) to control the position of one or more valves 64 between the open and closed positions.

To modulate interface pressure using internal air pressure, a monotonic relationship between internal pressure within one or more cavities 22 and an interface pressure (e.g., exerted on a person) can be established. This provides an indirect method to control interface pressure through modulating internal pressure of one or more cavities 22. System 10 can identify the change in external load by monitoring an internal pressure change then adjust the internal pressure accordingly. Using system 10, device 14 can realize a desired pressure profile by performing tasks such as pressure mapping, offloading, and redistribution. Pressure mapping within system 10 can update and/or record continuously and may be used to perform pressure modulation tasks. Redistribution of pressure throughout cavities 22 can be realized by assigning a uniform pressure value to all cavities while the cavities are subjected to the load of an external object (e.g., a person). This action uniformly redistributes the external load across a supporting surface of body 18. Offloading pressure at a select cavity 22 is accomplished by, for example, completely removing internal pressure from the cavity. By relieving this internal pressure, the force acting upon the external object at the location of the select cavity 22 will be decreased. In some cases, removing pressure in selected areas could result in increased pressure in the surrounding support areas. By monitoring and modulating the internal pressure of cavities 22, system 10 can uniformly redistribute the load over the remaining support surface. These pressure modulation techniques can reduce the magnitude and the duration of the interface pressure between a supporting surface and a person's body to prevent pressure ulcer formation.

The desired system outcomes, such as pressure mapping, offloading, and redistribution, are realized through a series of actions from the pneumatic and electrical components of system 10. For example, once a command to begin is received from GUI 34, pump 50 can provide airflow to pressure regulator 54, which proportionally adjusts a bleed valve to deliver a desired pressure to system 10. This pressurized air is distributed through manifold 60 to each cavity 22 using, for example, a (e.g., single two-way) solenoid valve 64, which can be controlled individually or in groups. Valves 64 can control the "on" and "off" flow of air to each cavity 22 and/or segment 35, thereby allowing system 10 to achieve different levels of inflation and/or deflation across individual cavities. An additional bleed valve can be added to manifold 60 to provide an exhaust route for the pressurized cavities 22. The internal pressure of cavities 22 can be exposed to in-line pressure sensors 26 which are read by one or more controllers 30 that monitor the pressure level of the cavities. The most current pressure sensor reading can be processed through different interpolation techniques and plotted in various formats to be displayed through GUI 34 and/or exported to another device. System 10 is scalable to a variety of applications through the inclusion or reduction of valves and sensors. In some embodiments, cavities (e.g., 22) can be grouped so that a single valve (e.g., 26) may regulate the pressure of multiple cavities.

Example 1

A test prototype was designed consisting of a 5×5 array of soft actuators (e.g., cavities 22) surrounded with foam to constrain lateral deformation of the actuators and an associated control unit, as seen, for example, in FIG. 1. System outcomes such as pressure mapping, offloading, and redistribution were realized through control of the electronic and pneumatic components which include a miniature air pump, a pressure regulator, a manifold with solenoid valves, pressure sensors, and a microcontroller board.

Design of a Soft Actuator

To test the pressure mapping and modulation capability of this concept, a section of the support surface was designed and fabricated. This support surface consisted of a 5×5 array of soft actuators (e.g., cavities 22) all of equal size and shape which helped to reduce the complexity of characterization and control. Each soft actuator was designed in a cylindrical shape, shown in FIG. 11, with a diameter 72 of 31 millimeters (mm) which covers a surface area of approximately 7.5 squared centimeters ($cm^2$). The size of this area was selected to be close to the smallest high pressure concentration area in the buttocks as reported in an air-cell-based cushion study (Hamanami K. Tokuhiro A, and Inoue H., 2004, "Finding the optimal setting of inflated air pressure for a multi-cell air cushion for wheelchair persons with spinal cord injury," *Acta Med.* Okayama, vol. 58, no. 1, pp. 37-44). An air inlet with a diameter 76 of 2.4 mm was placed underneath the center of the base for inflation. This design allows for individual control of each actuator and routes all pneumatic tubing underneath the array to avoid interference with the support surface. The actuator had a height 80 of 75 mm and a base thickness 84 of 5 mm, which resulted in a maximum immersion depth of 70 mm. This depth was chosen to accommodate the vertical distance between the ischial tuberosities and greater trochanters (~50 mm) without bottoming out. The actuator was made through a combination of injection and over molding processes using liquid polyurethane (PMC 724) with a Shore hardness of 40 A. A uniform thickness 88 of 1.1 mm was used for the sidewall and top surfaces of these actuators so that pressurization of these actuators would not result in large deformations. When used in a dense array with a uniform adjacent spacing of 2 mm, the fine granularity of these actuators allows local pressure monitoring and adjustment under high pressure concentration areas (i.e., the ischial tuberosities).

Actuator Testing

Figure 11:
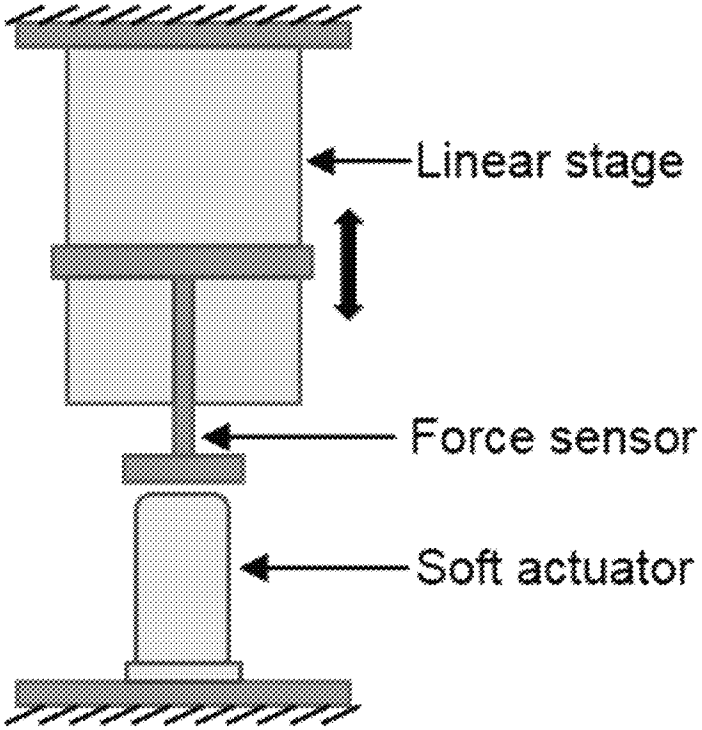
FIG. 11 is a schematic of an apparatus configured to test the portion of the body of FIG. 2.

To examine the integrity and the load bearing capability of an actuator (e.g., cavity 22) array when under external loading conditions, a single actuator (e.g., cavity 22) was tested by applying a range of normal forces at different inflation pressures. The change in internal pressure as a result of increased external loads was recorded during the test. A single inflated actuator was fixed onto a flat station and pressed down vertically from the top by a single axis force sensor (MLP-300, Transducer Techniques®) which was mounted on a linear stage as seen in FIG. 11. The exerted force on the actuator was measured by the force sensor as the linear stage traveled downwards compressing the actuator. As suggested in another air-cell-based cushion study, the optimal internal pressure for a uniform air-cell cushion is from 3.5 kPa to 10 kPa. The tests performed in this Example were done to ensure a large safety margin in our design while under load and as such, a set of inflation pressures ranging from 2.5 to 25 kPa were used in increments of 2.5 kPa while an applied external force ranging from 0 to 39N acted upon the actuator.

Figure 12:
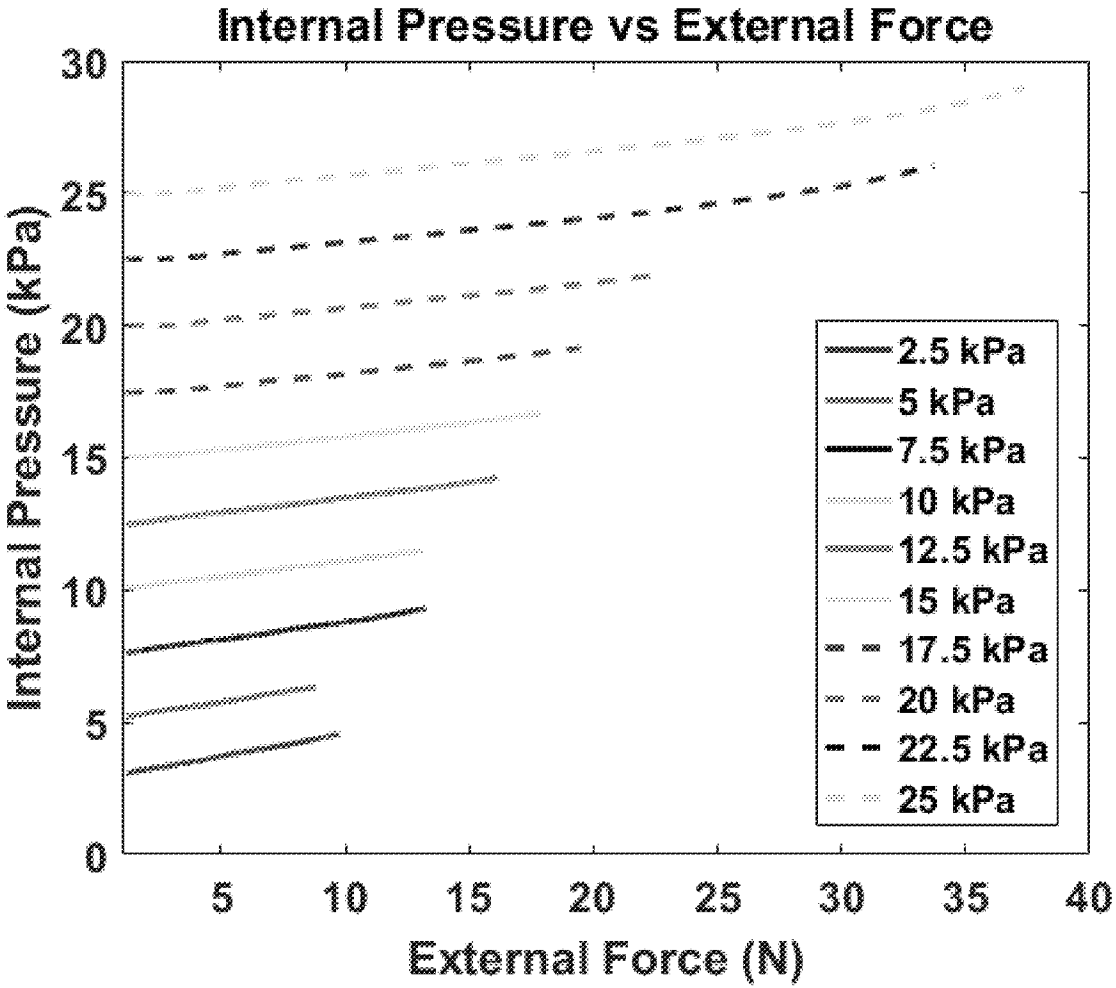
FIG. 12 is a graph showing an external force exerted on the portion of the body of FIG. 2 versus an internal pressure of the portion of the body of FIG. 2.

The increase in internal pressure and external force were recorded before observed buckling at each inflation pressure. All tests were repeated three times to ensure repeatability. As shown in FIG. 12, the actuator can reach an internal pressure of 29 kPa while experiencing an external load without failing. Irrespective of the initial inflation pressures, the internal pressure is observed to be increasing when external force increases. This indicates a monotonic and almost linear relationship between internal pressure and external load. Additionally, the contact model from the following equation shows a linear relationship between applied external load ($F_{ext}$) and the interface pressure ($P_{interface}$) when the change in contact area is insignificant:

$$P_{interface} = \frac{F_{ext}}{A_{contact}}$$

The observed relationship between internal pressure and external loading along with assumed contact model indicates that lowering internal pressure of an actuator can reduce the interface pressure at the area of contact. The observations made with a single actuator are applied to the actuator array by neglecting neighboring actuator interactions and buckling of the actuators. This Example forms a basis for controlling internal pressure of actuators to regulate interface pressure.

Pressure Modulation Test Setup

Figure 13:
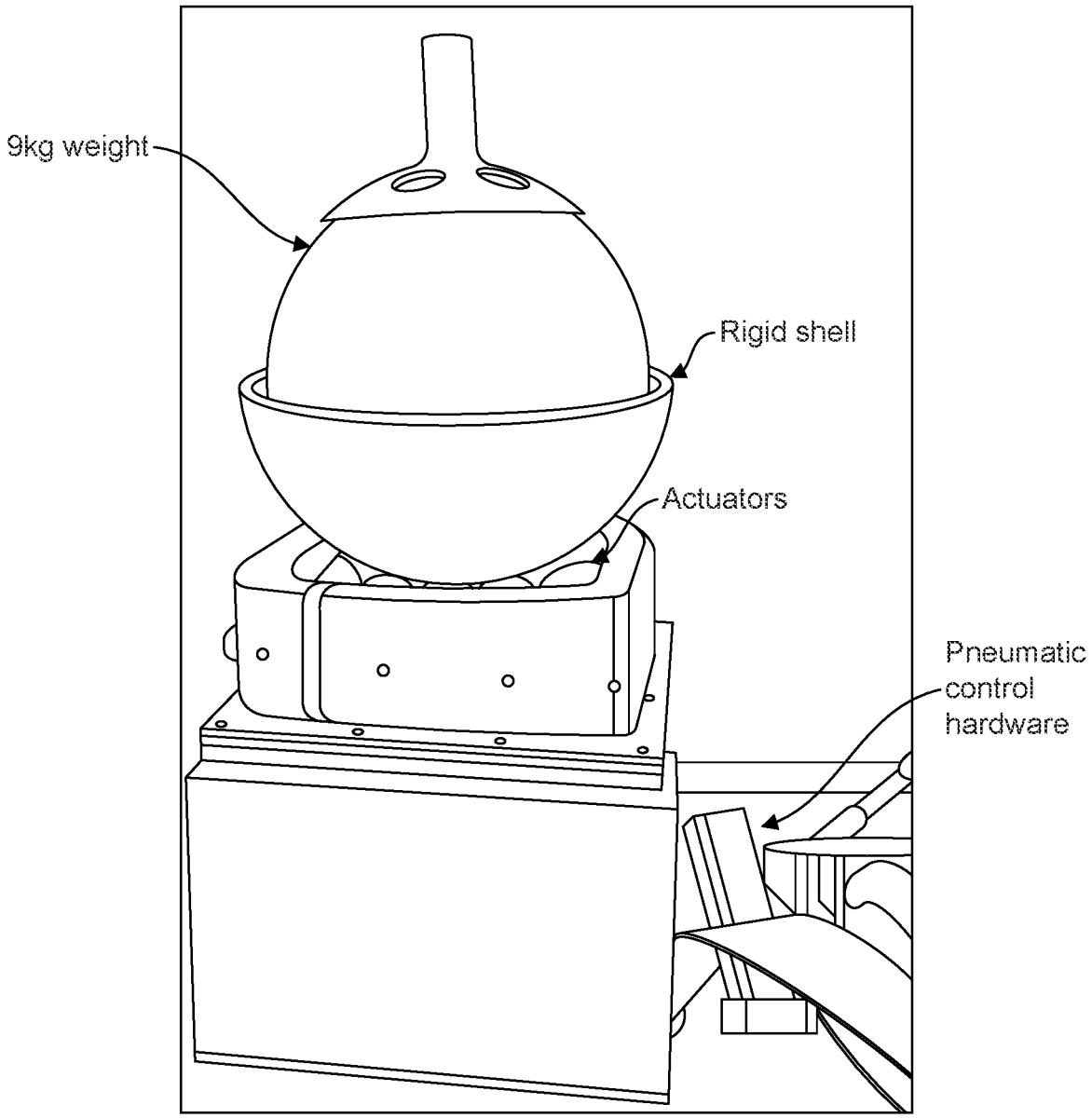
FIG. 13 is a perspective view of an apparatus configured to test one embodiment of the present devices.

A series of experiments were conducted validate the 5×5 actuator array prototype's pressure modulation capabilities. As shown in FIG. 13, a rigid hemispherical shell with a diameter of 22.9 cm and a weight of 9 kg was used to apply an external load to the support surface prototype. All internal pressure and external force data were continuously recorded at a rate of 60 Hz. The pressure profile was captured by the GUI at various instances to demonstrate automatic redistribution, offloading, and manual offloading. Contour plots of raw data corresponding to a grid of 25 pressure sensors was recorded for each dataset along with an interpolated counterpart for legibility. These interpolations were performed with biquadratic basis functions on a 50×50 grid.

During every test, the shell along with the weight was placed at the center of the support surface where all actuators were initially inflated to a constant pressure of 3.5 kPa. Automatic uniform redistribution was performed by activating the corresponding algorithm. It first synthesizes a desired uniform pressure profile based on the average value of sensed pressure throughout the array and then exposing the actuators to this determined pressure value. Automatic offloading was performed by an algorithm synthesizing a list of actuators to be offloaded based on a parameterized threshold pressure. The system could then perform offloading by deflating the listed actuators to atmospheric pressure, thus relieving their inflation. Manual pressure offloading was performed by the user setting the internal pressure of selected actuators to zero. The observations made while performing each of these pressure modulation tasks was reported as a result of this work.

Automatic Pressure Redistribution

Figure 14:
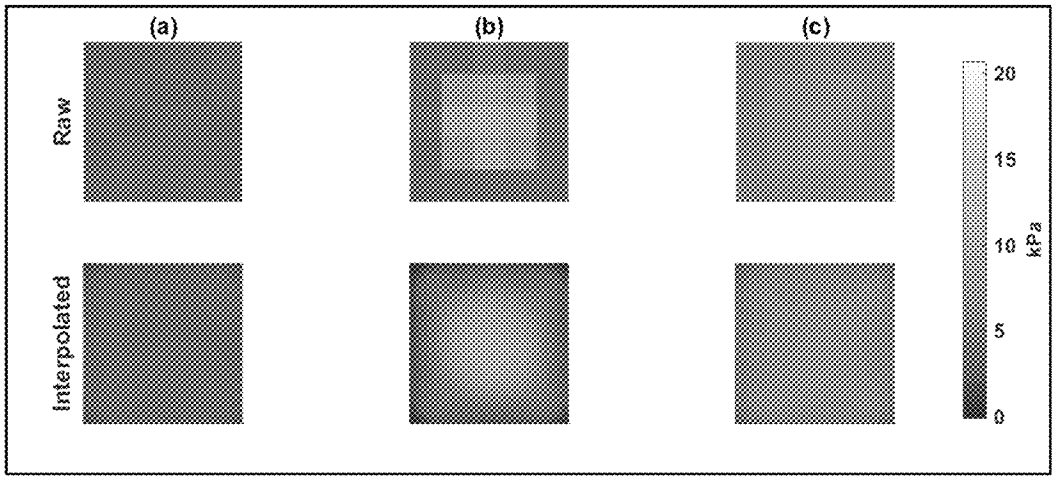
FIGS. 14-16 depict pressure profiles during automatic pressure redistribution, automatic pressure offloading, and manual pressure offloading, respectively.

Initially all actuators were inflated to a pressure of 3.5 kPa, as shown in FIG. 14(*a*), which generated a uniform pressure distribution across the entire support surface. FIG. 14(*b*) displays the concentrated pressure at the center after placing the weight on the support surface due to the geometry of the object. Automatic pressure redistribution is achieved using an algorithm which assigns a new constant pressure to all actuators by multiplying a safety factor of 1.1 with the calculated average pressure across all actuators. The formula for calculating uniform commanded pressure is an empirical estimation with a safety factor included:

$$P_{uniform}=1.1\times P_{Average}$$

Nearly uniform pressure distribution was achieved with an acceptable tolerance as shown in FIG. 14(*c*). It was observed that by redistributing the pressure, the immersion of the weight into the actuator array is increased and that the contact area also increases which indicates a reduction in peak interface pressure. This experiment shows the capability of the controller to regulate the pressure to a uniform distribution. By automatically assigning a calculated uniform pressure based on the current pressure profile across the support surface, the concentration of interface pressure is reduced. However, a minimum internal pressure value must be maintained after redistribution to prevent collapse. This pressure is dependent on the weight of the object placed upon the support surface as well as the initial pressure distribution and hardness of the object.

Automatic Pressure Offloading

Figure 15:
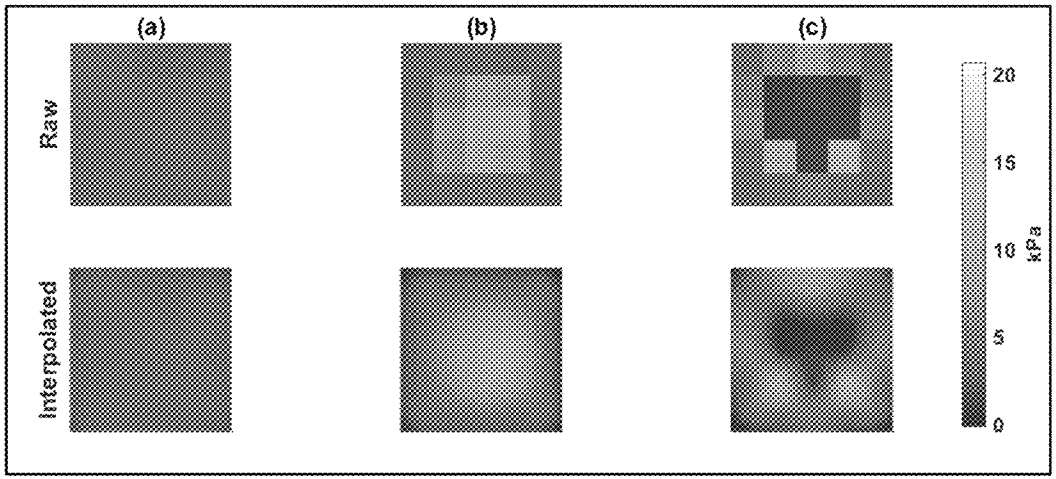

As with the previous approach, the pressure profile is obtained when the weight is placed on the support surface at an initial inflation pressure of 3.5 kPa as shown in FIG. 15(*a*). An automatic high pressure detection algorithm was used to synthesize a list of actuators which required offloading based on a calculated threshold. This particular offloading algorithm parameterizes the threshold pressure as a linear sum:

$$P_{threshold}=(1-\sigma)\max\overline{P}+\sigma(\min\overline{P})$$

where $\overline{P}$ represents an array of internal pressures shown in FIG. 15(*b*). This is a convenient notation since $\min \overline{P}<P_{threshold}<\max \overline{P}$ when the parameter $\sigma$ is in the interval (0, 1). It was observed that the algorithm automatically offloaded all the actuators with a pressure greater than $P_{threshold}$ while keeping the other actuators closed as shown in FIG. 15(*c*). The presented results were achieved with $\sigma=0.5$. Note that a higher a represents smaller regions of offloading centered on high pressure regions and vice versa. This capability helps to identify and offload the concentrated pressures when they are over a defined parameterized threshold; however, the remaining support surface must accommodate for additional weight and may result in additional high pressure concentrations which must be relieved by redistribution.

Manual Pressure Offloading

Figure 16:
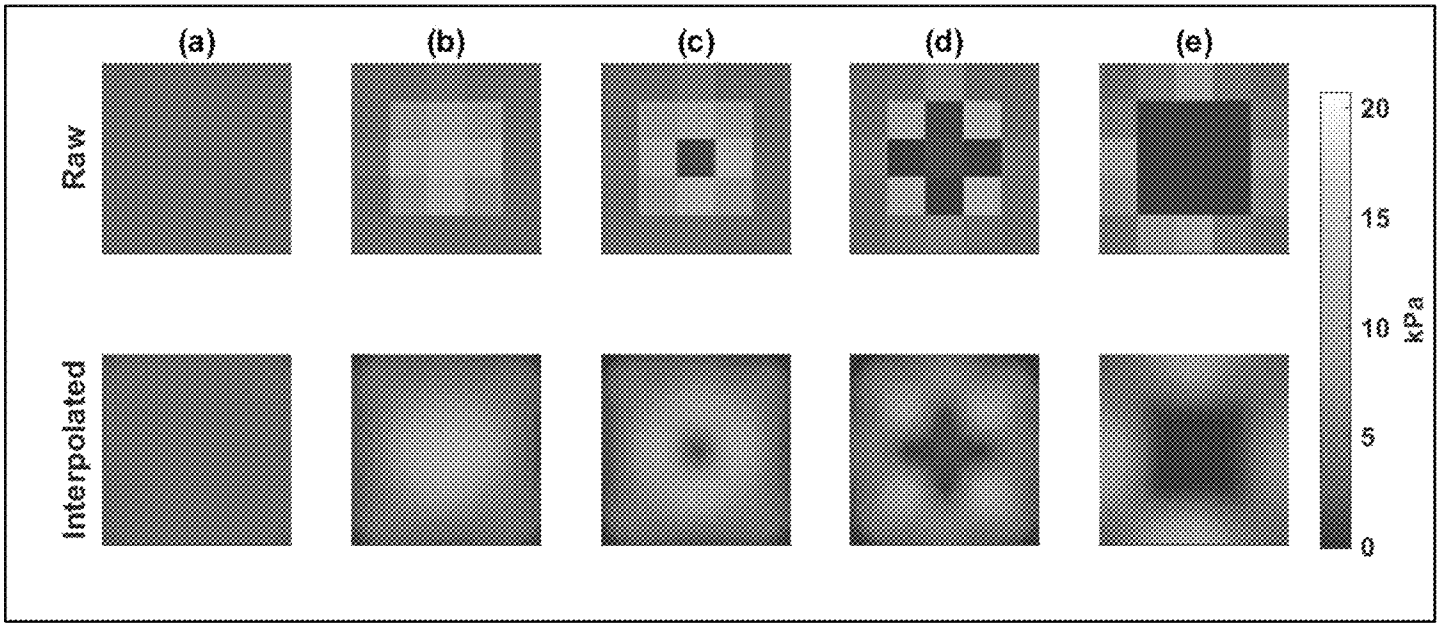

In addition to automated pressure manipulation capabilities, the system also allows the user to manually adjust the pressure of select actuators. This enables a user to remove interface pressure from a sensitive region due to pre-existing conditions such as a pressure ulcer or other injury. To test this capability, all actuators were inflated to an initial pressure of 3.5 kPa as shown in FIG. 16(*a*). After the weight was placed on the support surface and the pressure of all actuators stabilized, FIG. 16(*b*), the pressure of the center actuator was manually selected and set to zero. It was observed that manual offloading of the center actuator did not significantly affect the overall pressure distribution as seen in FIG. 16(*c*). After manually offloading the pressure at four additional central actuators, FIG. 16(*d*), the internal pressure of the remaining actuators began to increase. After offloading the pressure from a total of nine central actuators, the weight was completely borne by the outside actuators surrounding the offloaded area, seen in FIG. 16(*e*). The resulting pressure was distributed almost uniformly among the soft actuators in contact with the spherical weight. The maximum internal pressure, 9.5 kPa, was below the suggested threshold value for air-cell-based cushions; therefore, no further pressure redistribution was performed.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

Example 2

Figure 17:
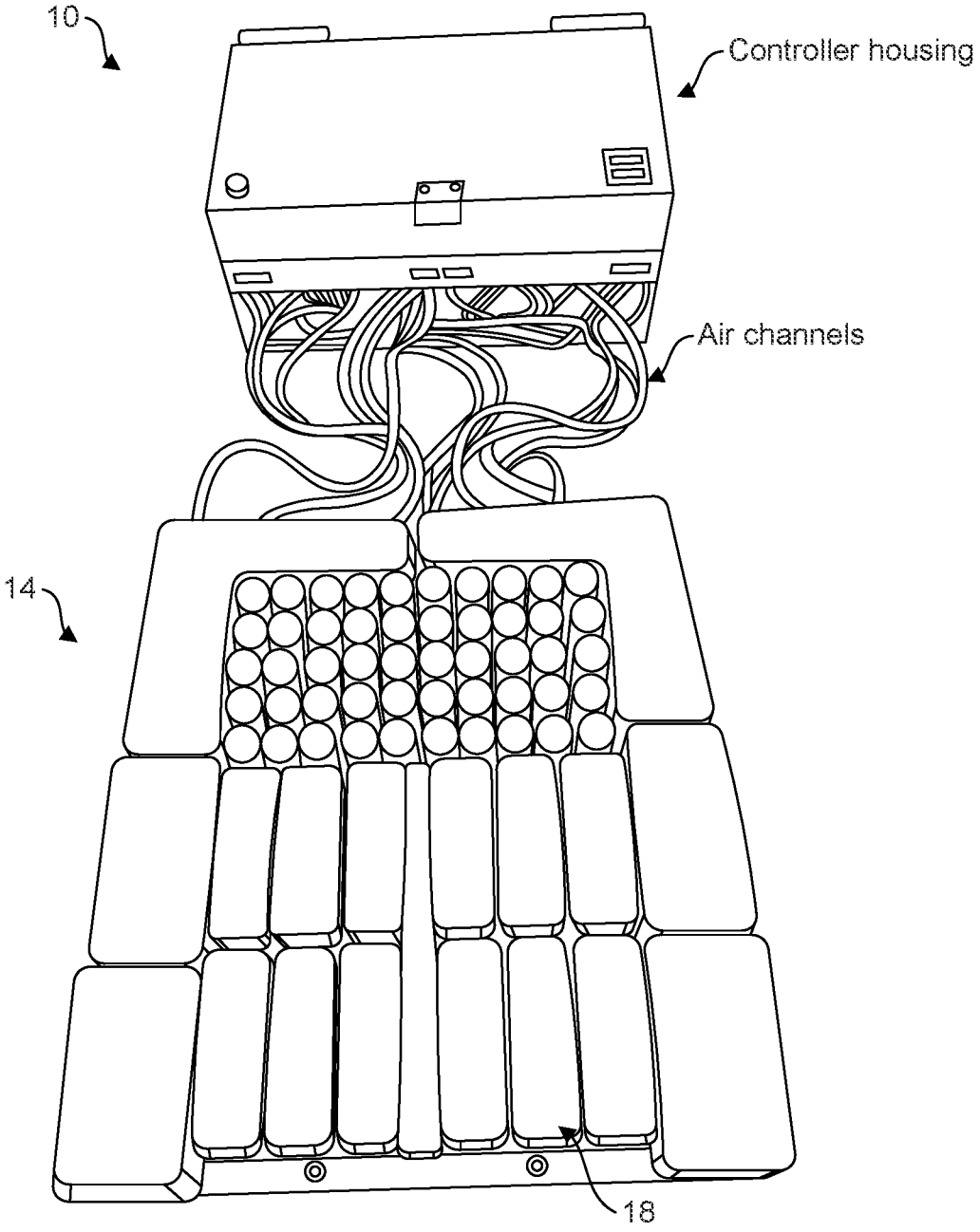
FIG. 17 depicts an example of a fabrication of one embodiment of the present systems.

A sample of the present system (e.g., 10) is shown in FIG. 17 which included a fabricated seat cushion prototype comprising 62 air cell bodies (e.g., 18) and surrounding foam block and an associate control unit designated for pressure mapping, offloading, and redistribution. As shown, the cushion (e.g., 14) included 50 smaller bodies that were located at the posterior of the cushion and 12 larger bodies were placed at the anterior. The smaller bodies enabled high resolution pressure mapping and more efficient pressure modulation under ischial tuberosities and the sacrum, areas which are highly vulnerable to pressure ulcer formation. The cushion (e.g., 14) was connected to a controller housing that included electronic and pneumatic components, as described in further detail below, which was connected to a computer using a serial port (USB) connection. As shown, the cushion (e.g., 14) was pneumatically connected to the controller housing using a bus of 62 air channels.

Figure 18:
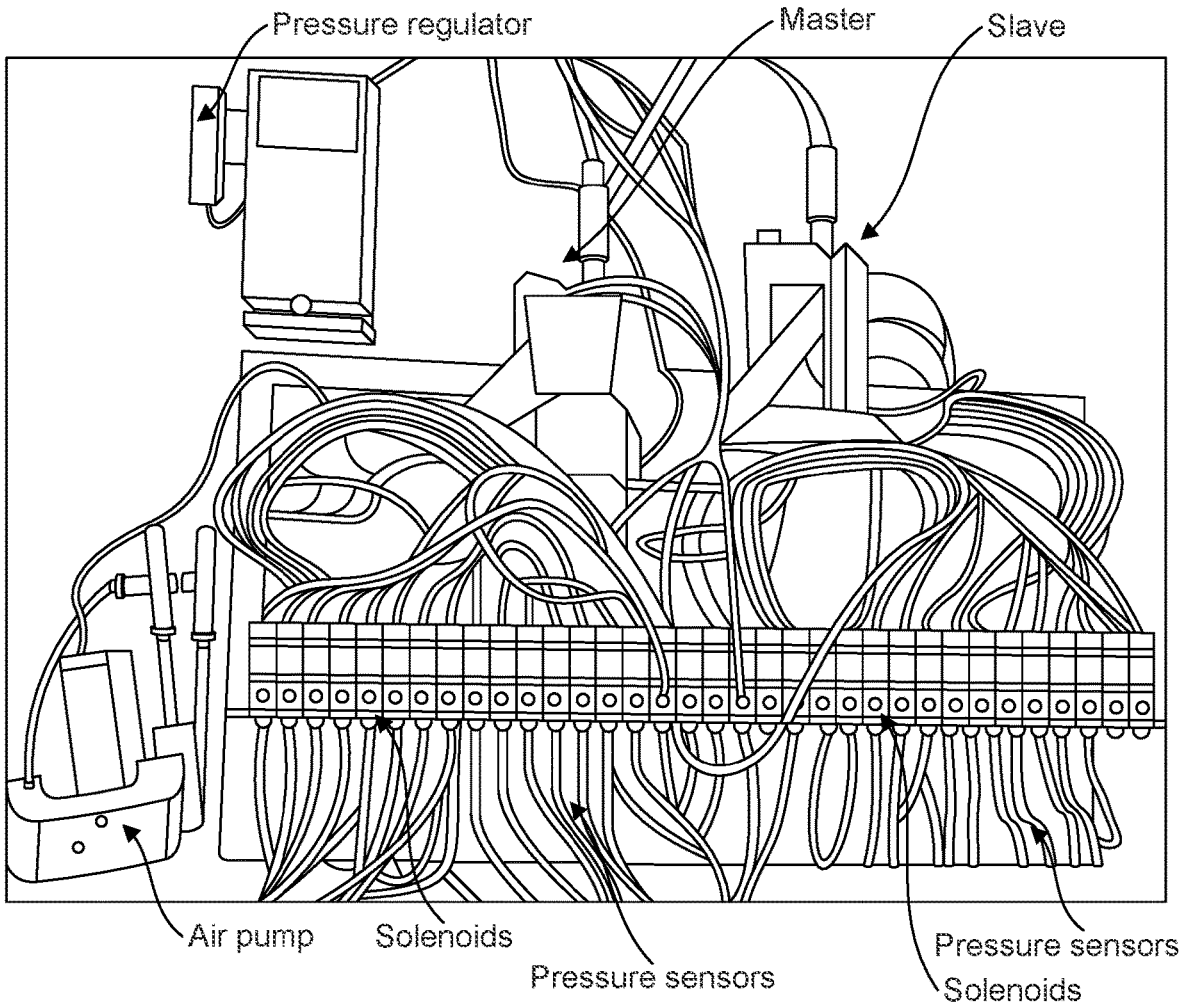
FIG. 18 depicts electronic and pneumatic components of the system of FIG. 17.

The controller housing included an assembly of various modules designed for specific tasks and functions, as shown in FIG. 18, which enabled pneumatic control of the bodies. These modules included: a power supply, an array of solenoids (e.g., 64), an array of electrically controlled power switches, an array of MEMS air pressure sensors (e.g., 26), a miniature air pump (e.g., 50), an air pressure regulator (e.g., 54), and a Master/Slave configuration of microcontrollers (e.g., 30). The power supply module provided power at the various voltages needed throughout the control system, specifically 5V, 12V, and 24V. The system (e.g., 10) also contained 4 interconnected manifolds (e.g., 60) of 16 arrays of solenoids, each of which is connected to a respective body. One of the remaining solenoids was left unconnected for exhaust. The pump was selected such that it was capable of providing a high flowrate to supply the high volume of air needed to fill each of the bodies in the entire cushion. The air pressure regulator was added to reduce the high air pressure from the pump down to the desired inflation pressure commanded by the user. Two microcontrollers were implemented in this design to support the high number of analog inputs needed for sensor data acquisition as well as the increase in the number of digital channels required to actuate each electrical switch controlling the solenoid valves. These components allowed the system to perform inflation, sensing, offloading, and redistribution in the bodies across the entire seat cushion.

Electronic Layout

Figure 19:
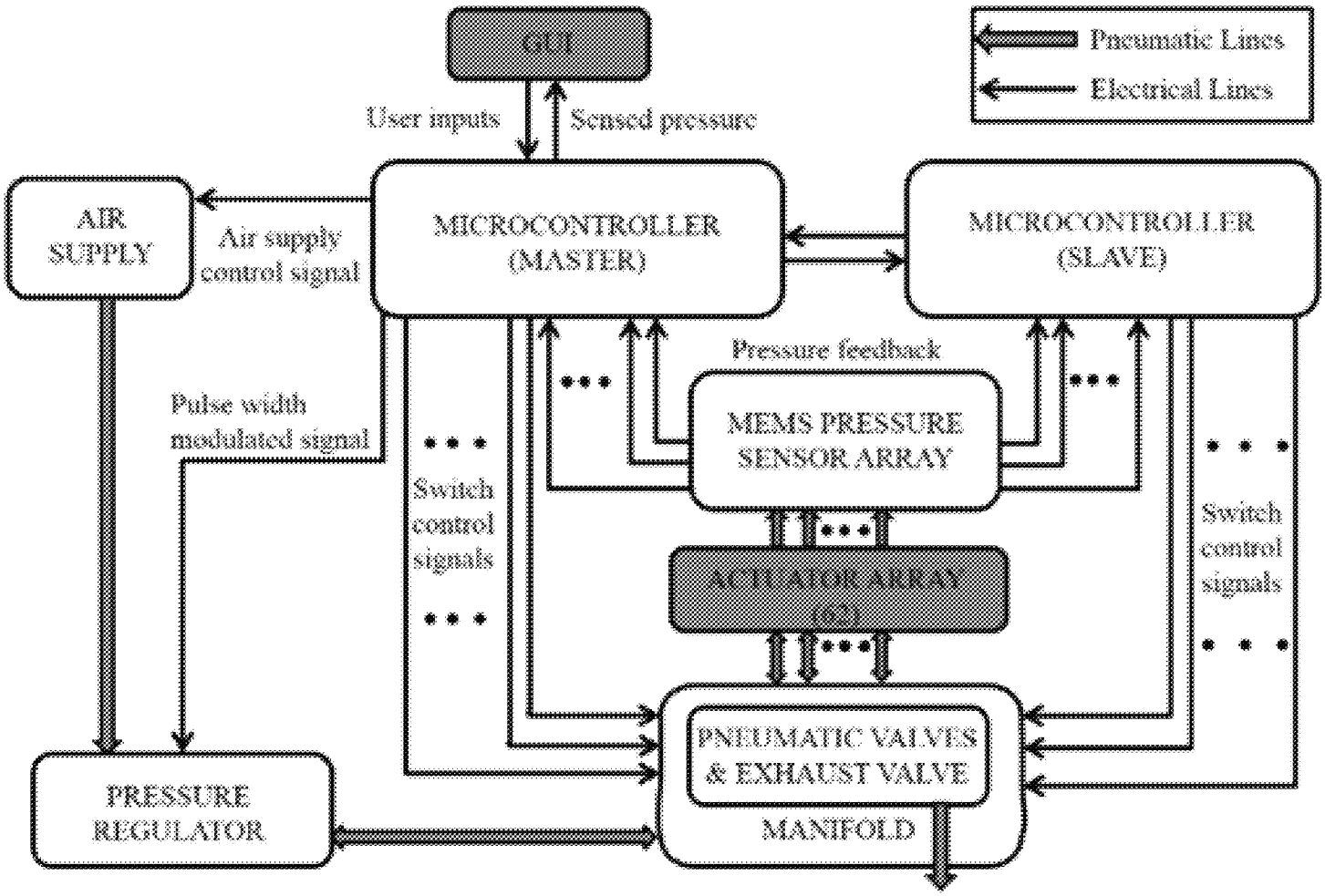
FIG. 19 depicts a schematic of the electronic and pneumatic components of the system of FIG. 17.

The electronic layout of the various components of the system is shown in FIG. 19. The microcontrollers were used in the system to independently control and monitor the independent pressure in 62 air cells. Two microcontrollers were used, rather than only a single microcontroller, due to the large number of analog inputs and digital outputs. The sensors and solenoids for the bodies numbered 1-31 (e.g., FIGS. 22-24) were connected to a first (e.g., Master) microcontroller, and the sensors and solenoids for the bodies numbered 32-62 (e.g., FIGS. 22-24) were connected to a second (e.g., Slave) microcontroller. Because the pump, pressure regulator, and exhaust solenoid could not be controlled by two microcontrollers at the same time, the pump, pressure regulator, and exhaust solenoid were connected to the first microcontroller and the second microcontroller was configured to convey data indicative of the sensor input and solenoid output of bodies numbered 32-62 to the first microcontroller. The first and second microcontrollers were connected via an I2C bus, which transmitted internal pressure data of the bodies to the first microcontroller. The first microcontroller in turn commanded the second microcontroller to switch its solenoids off and on. Such a transmission is made in real time after optimizing the amount of data sent between the microcontrollers so that the transmission is performed instantaneously with latency minimized.

Pneumatic Layout

As shown in FIG. 19, the pneumatic layout was designed to achieve control of the 62 bodies using a single pump (labeled "air supply" in FIG. 19). The pump was connected to the manifolds via the linear pressure regulator, which stepped down and smoothened the pump's oscillating pressure for the manifolds. As discussed above, the system had four interconnected manifolds, each of which were connected to 16 solenoids. Each solenoid was connected to its respective body and a MEMS pressure sensor. The only unused solenoid on the first half of the array was left open to the atmosphere to serve as an exhaust port which could be turned on and off to bleed air as needed. At any given time, air was either being pumped into the manifold from the pump or exhausted out through the exhaust solenoid to avoid the simultaneous operation of the solenoid exhaust and the pump. The solenoids corresponding to each body fluidly coupled the respective body to the manifolds, which were either under pressure or connected to the exhaust solenoid.

Control Implementation

Figure 20:
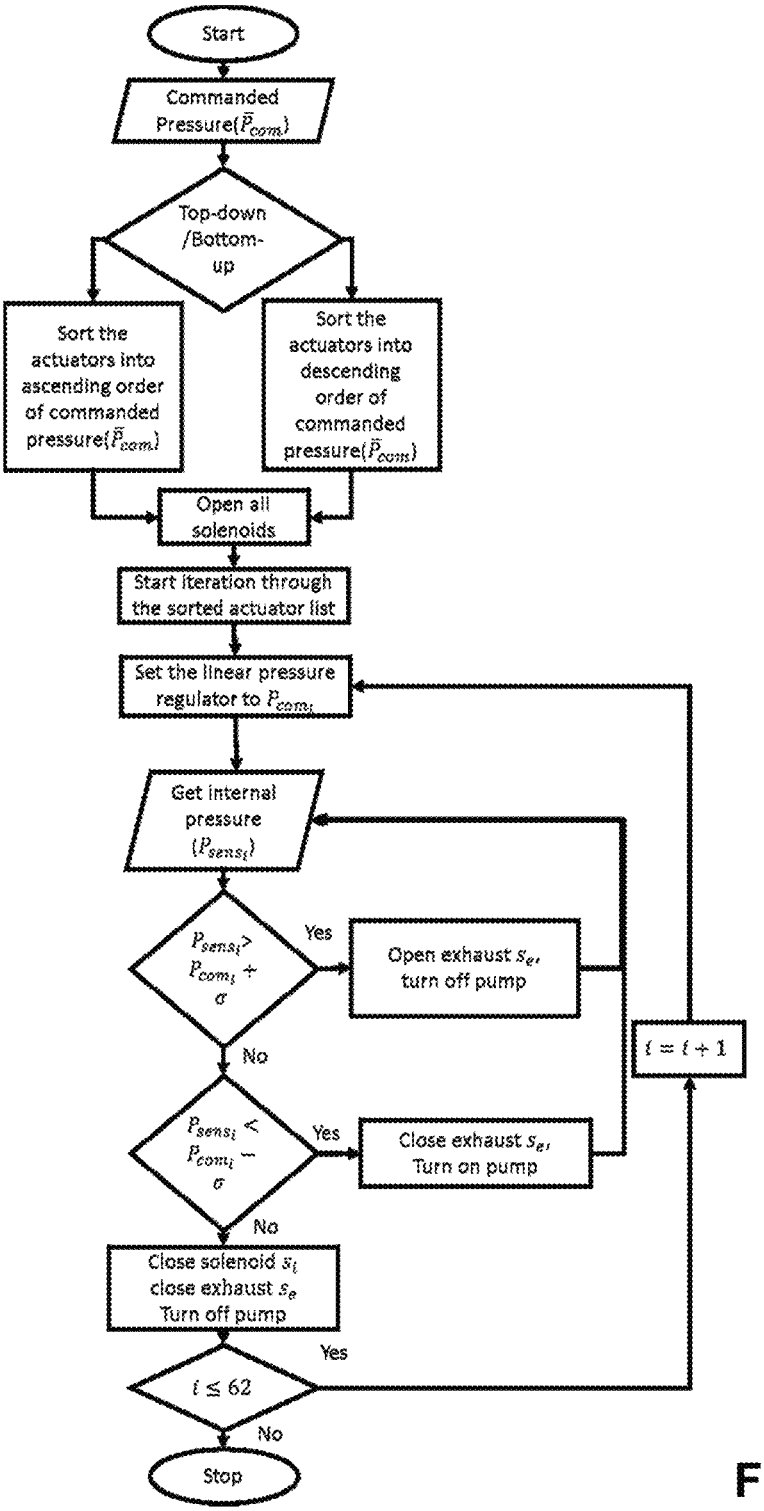
FIG. 20 depicts a flowchart for a scheduling bang-bang control algorithm, suitable for implementation by the system of FIG. 17.

The flowchart for implementing the controller discussed in this Example is shown in FIG. 20. For convenience, the following nomenclature is used in this Example:

| | |
|---|---|
| $P_{sens_i}$ | Sensed internal pressure in $i^{th}$ air cell body |
| $P_{com_i}$ | Commanded internal pressure in $i^{th}$ air cell body |
| $\sigma$ | Dead zone parameter for bang-bang controller |
| $P_{lpr}$ | Commanded pressure for linear regulator |
| $s_i$ | State of solenoid corresponding to $i^{th}$ air cell body |
| $S_e$ | State of the exhaust solenoid |
| $\overline{P}_{com}$ | Vector of commanded pressures |
| $\overline{P}_{sens}$ | Vector of sensed internal pressures |
| $P_{min}$ | Minimum pressure among $\overline{P}_{sens}$ |
| $P_{max}$ | Maximum pressure among $\overline{P}_{sens}$ |

The two microcontrollers, pneumatic sensors and solenoids, pump, and linear pressure regulator tracked a given commanded internal pressure in the 62 different volumes of the bodies. In reference to FIG. 20, the internal pressure detected by the pneumatics sensors, which were connected to each body's volume, is denoted by $P_{sens_i}$ and the commanded internal pressure for each volume is denoted by $P_{com_i}$, where i denotes the $i^{th}$ body. The control objective was to regulate the internal pressures $P_{sens_i}$ so that $|P_{sens_i}-P_{com_i}|<\sigma$ for a small enough $\sigma$ using a linear pressure regulator $P_{lpr}$, solenoids $s_i$ connecting the body volumes to the manifolds, and exhaust solenoid $s_e$ connecting the manifolds to the atmosphere.

Given the pneumatic layout of the system, the proposed control algorithm used time division multiplexing to share the common resources of the pump, linear pressure regulator, and exhaust with each of the 62 bodies via the manifolds. The proposed algorithm was loosely based on a bang-bang controller with a dead zone (See Vermeulen, J., Verrelst, B., Vanderborght, B., Lefeber, D., and Guillaume, P., 2006. "Trajectory Planning for the Walking Biped Lucy". *The International Journal of Robotics Research,* 25, 9, 867-887 and Faudzi A. A. M., Suzumori K. and S. Wakimoto, "Design and control of new intelligent pneumatic cylinder for intelligent chair tool application," 2009 *IEEE/ASME International Conference on Advanced Intelligent Mechatronics*, Singapore, 2009, pp. 1909-1914). The controller of the present system achieved the commanded pressures by pumping or exhausting air continuously until the internal pressure was regulated to an acceptable tolerance, $\sigma$. The proposed algorithm also showed the scheduling aspect of regulating multiple volumes, which was performed using either a 'Top-down' or 'Bottom-up' approach. For example, in the 'Bottom-up' approach, all the volumes were regulated to the minimum $P_{com_i}$ until the $|P_{sens_i}-P_{com_i}|<\sigma$, and then the rest of the volumes were regulated to the next lowest pressure and so on until all the volumes were regulated to their respective commanded pressures. In the 'Top-down' approach, all the volumes were regulated to the maximum $P_{com_i}$ until the $|P_{sens_i}-P_{com_i}|<\sigma$, and then the rest of the volumes were regulated to the next highest pressure and so on until all the volumes were regulated to their respective commanded pressures. The 'Bottom-up' approach was the most energy efficient due to the minimal pumping and exhausting used when the volumes were not under load. However, the 'Top-down' was found to be the least intrusive when the volumes were already pressurized and needed to be only exhausted selectively.

The first or second microcontroller obtained the commanded internal pressure map ($\overline{P}_{com}$) from the GUI. Depending on whether 'Top-down' or 'Bottom-up' was selected, an ascending or descending order of volumes was created. All the volumes of the air cell bodies were then regulated to the minimum or maximum of the commanded internal pressure map, respectively, until the absolute value of the error was less than $\sigma$. The exhaust solenoid was opened and the pump was turned off if the sensed pressure was greater than $P_{com_i}+\sigma$. Conversely, the exhaust solenoid was closed and the pump was turned on if sensed pressure was less than $P_{com_i}-\sigma$. If the absolute value of the tracking error is less than $\sigma$, the corresponding solenoid $s_i$ was closed. This process is repeated until all the air cell bodies were regulated to their commanded pressure within a given tolerance, $\sigma$. Although the FIG. 20 shows the algorithm for all 62 air cell bodies, the algorithm can also be used for any given subset of air cell bodies selected through the GUI.

Practical Considerations

The range of the analog MEMS pressure sensors combined with a 10-bit ADC resolution resulted in a 0.1 kPa sensing resolution for each $P_{sens_i}$. Similarly, the range of the linear pressure regulator combined with 8-bit DAC resolution of the first and second microcontroller resulted in a 0.27 kPa commanded pressure resolution. The tolerance a, which determined the end condition, was chosen to be greater than either of these resolutions so that there was a greater chance of capture. It was found that 0.5 kPa was the minimum tolerance which yielded capture in most cases.

Use-Case Scenarios

The controller, which was capable of regulating the internal pressures of the air cell bodies to any given commanded pressure map, could be leveraged to include special operations for the treatment of pressure ulcers. Two such special operations were defined here for validation: offloading and redistribution. Given an initial pressure map of a seated person, an offloading operation commanded the internal pressure in higher pressure areas to zero. A redistribution operation, on the other hand, commanded the internal pressure within any given set of air cell bodies to a constant value. An offloading operation relieved pressure from high pressure areas, whereas the redistribution operation distributed the weight of the seated person uniformly across the seating area. These two scenarios were tested for validating the operation of the seat cushion device.

Validation Studies

Figure 21:
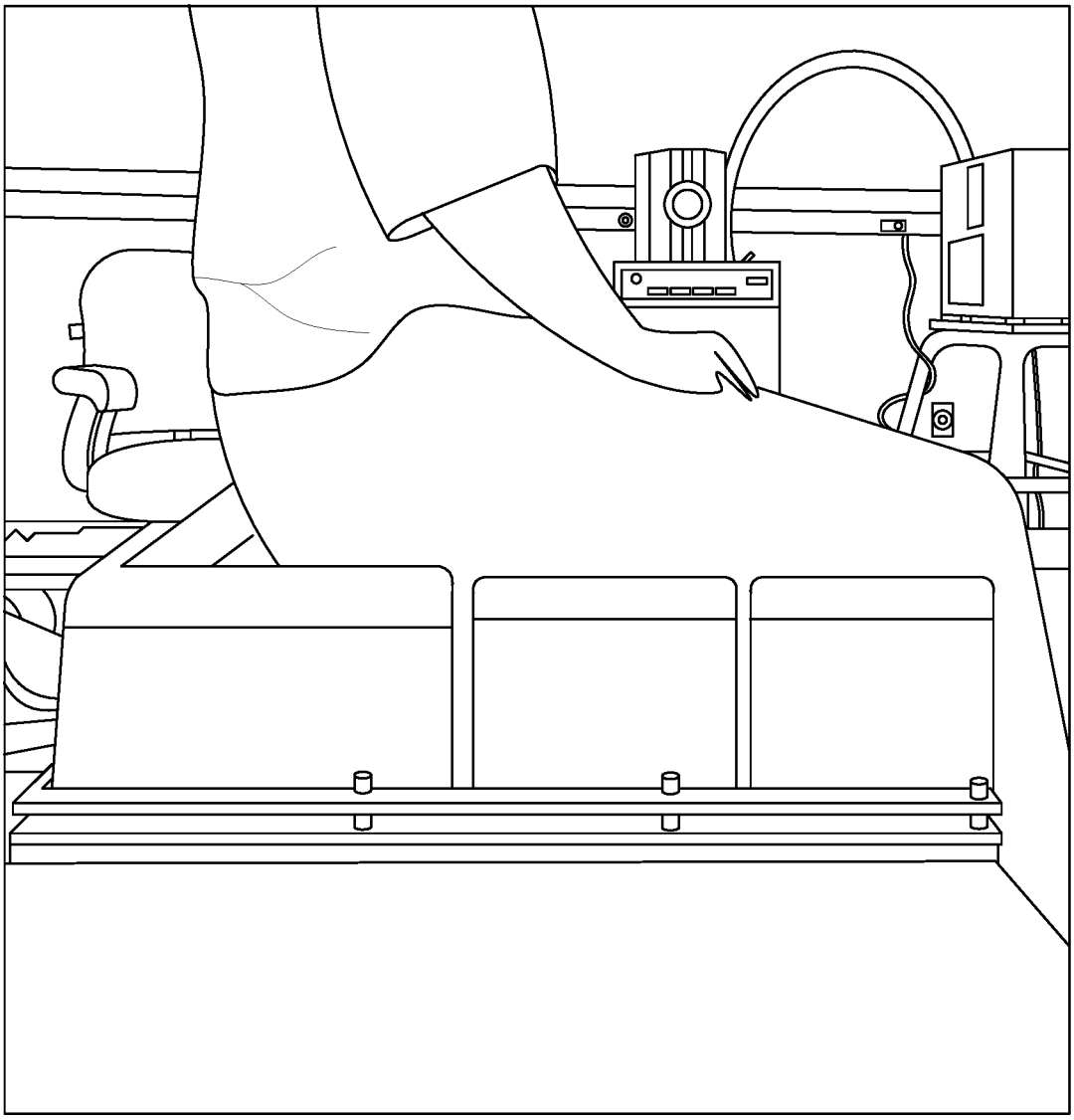
FIG. 21 depicts a subject sitting on a portion of the system of FIG. 17.

Pressure offloading and redistribution tests were used to validate the control implementation of the seat cushion prototype. Three studies were conducted to demonstrate the capability of the controller to facilitate pressure mapping and automated pressure modulation. The captured pressure maps having 62 instantaneous pressure values (corresponding to the 62 air cell bodies) were shown after interpolating the non-uniform internal pressure data over a uniform finer mesh of 200×200 resolution spanning the seating area. The MATLAB subroutine 'griddata' was used to facilitate biharmonic spline interpolation of the non-uniform data. All the tests were performed starting from a neutral seating position with a volunteer as shown in FIG. 21.

Figure 22:
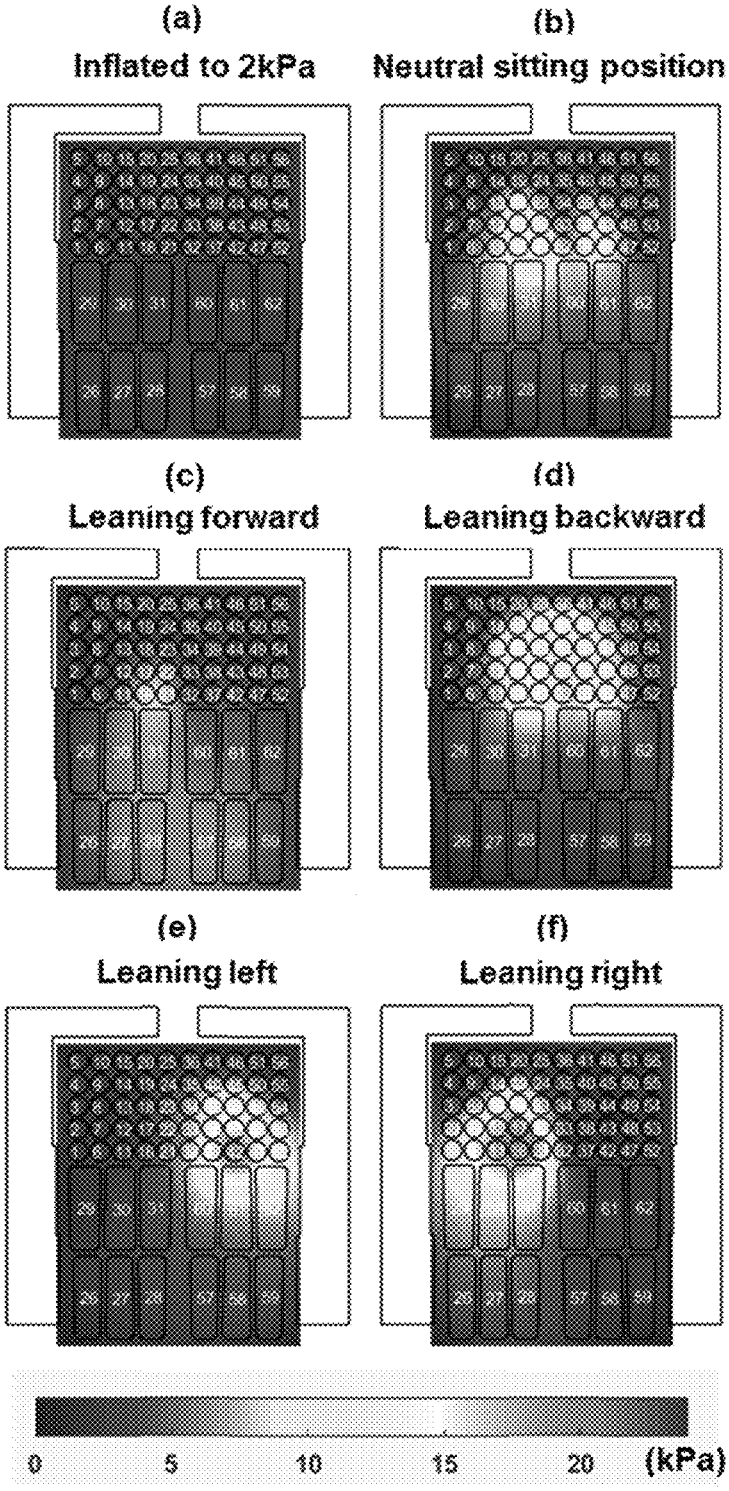
FIGS. 22-24 depict pressure mapping profiles.

In the first study, the pressure mapping was validated with shifting body weight. All air cell bodies in the seat cushion were uniformly inflated to a constant pressure of 2 kPa, as shown in FIG. 22(*a*). The controller took about 62 seconds to inflate the whole seat cushion to the given pressure starting from 0 kPa. A volunteer was then seated on the cushion in a neutral upright position without foot support. The initial seating pressure profile is shown in FIG. 22(*b*). It can be observed that the anatomical features are prominently depicted in the pressure map. The two distinct pressure concentration areas correspond to the ischial tuberosities.

Then a series of seating pressure profiles were captured when the subject shifted weight at different seating postures: leaning forward (FIG. 22(*c*)), backward (FIG. 22(*d*)), left (FIG. 22(*e*)), and right (FIG. 22(*f*)). As expected, only the air cell bodies bearing the body weight reported higher pressure values and other non-contacted ones remained at the initial inflation pressure level during the weight shifting. It was also observed that the pressure changes from shifting weight were instantaneous without notable delay. The GUI depicted an interpolated map as shown in FIG. 22, which is a more intuitive representation than an array of numbers thus making it suitable for clinical use.

Figure 23:
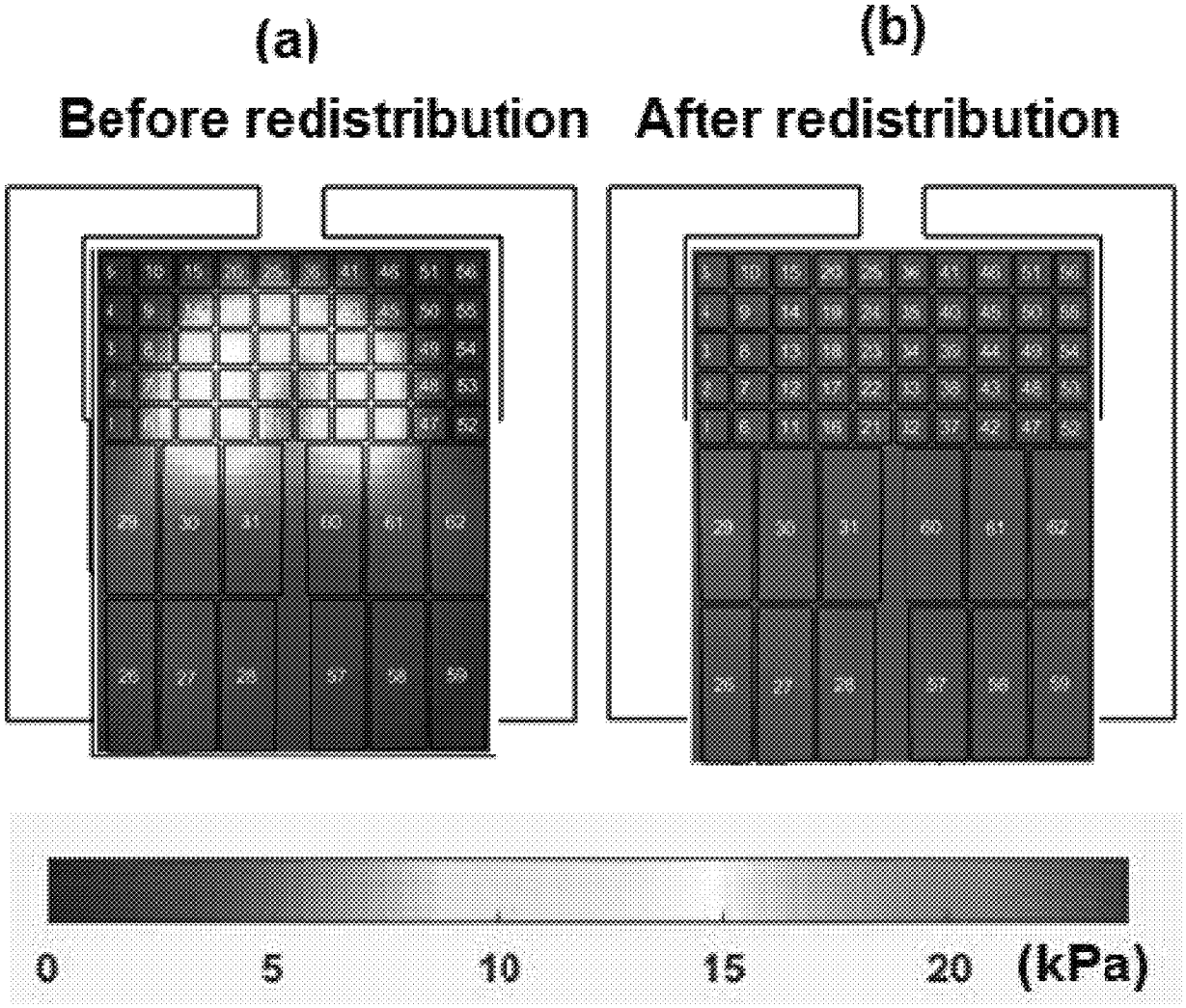
Figure 25:
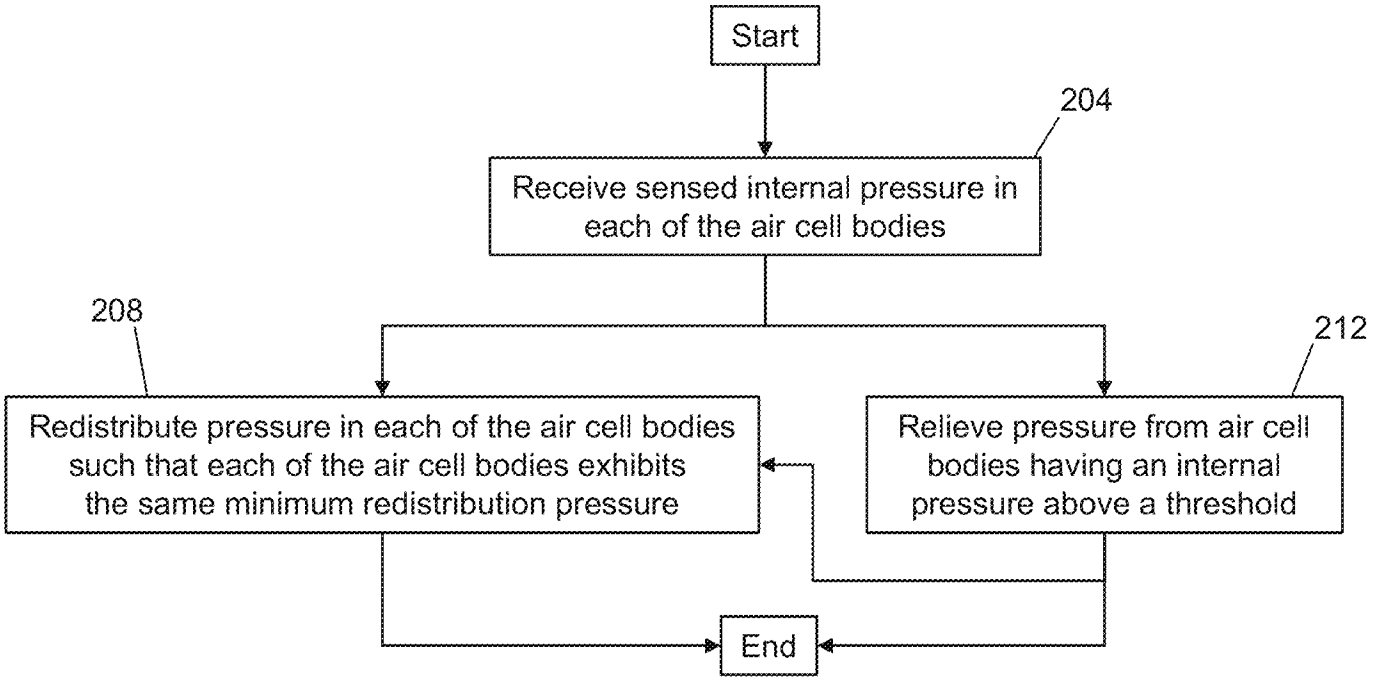
FIG. 25 depicts a flow chart for offloading and/or redistributing pressure within the system of FIG. 17.

The second study demonstrated the redistribution capability where the system redistributed the resultant pressure map from a sitting person to a uniform pressure map of any given pressure. FIG. 23 shows an initial pressure map which resulted from seating a person weighing 132 pounds onto the cushion with a uniform initial inflation pressure of 0 kPa for all air cell bodies (see FIG. 25, step 204). The anatomical features of the seated person can be observed in FIG. 23(*a*), where areas of high pressure occur at ischial tuberosities. Note that the pressure for such a redistribution procedure was initially computed as an average internal pressure of air cell bodies in FIG. 23(*a*) and then reduced to 2.5 kPa as seen in FIG. 23(*b*) with the person still seated on the seat cushion, thereby neutralizing otherwise high pressure areas (see FIG. 25, step 208). The average air pressure could have been further reduced gradually until just before the air cell bodies bottom out (i.e. air pressure no longer supports the weight) in order to reduce interface pressures further. The second study was repeated for three individuals of weights 110, 132, and 182 pounds with a minimum redistribution pressure of around 2.5 kPa. This study showed the redistribution capability of the seat cushion and the resolution of the redistributing pressure.

Figure 24:
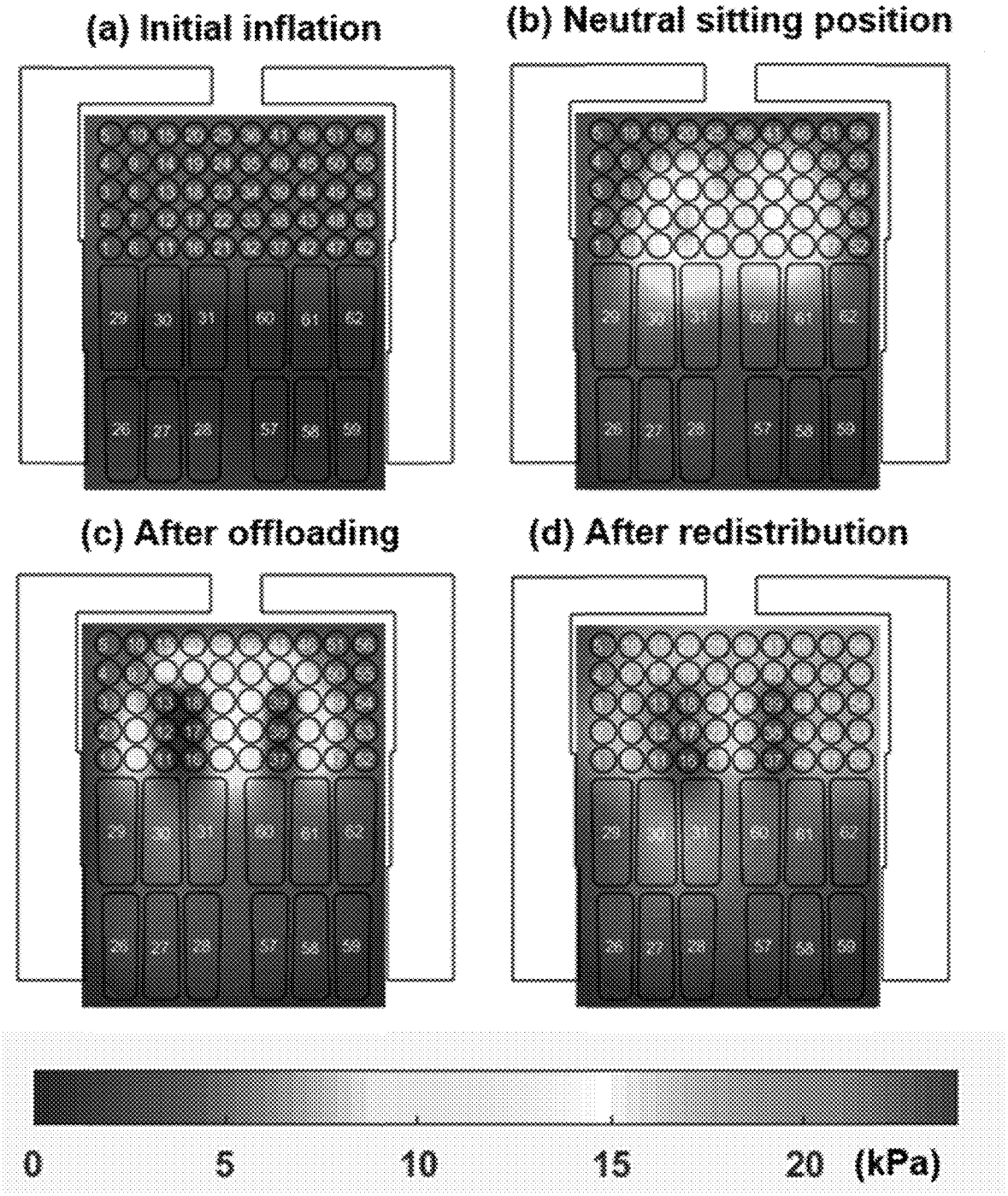

The third study demonstrated the automated pressure modulation capability where the system identified the pressure concentration areas to perform offloading followed by pressure redistribution among the remaining air cell bodies. Initially, the anterior and posterior areas of the cushion were pressurized to different levels. The smaller air cell bodies under the ischial tuberosities in the posterior area were inflated to 3.5 kPa and the bigger air cell bodies under the thighs remained at zero gauge pressure. The initial pressure map after inflation of all air cell bodies is displayed in FIG. 24(*a*) (see FIG. 25, step 204). The resulting pressure map shown in FIG. 24(*b*) depicts the subject seated in a neutral seating position. It can be observed that the pressure concentration occurred under the ischial tuberosity area. Pressure offloading was performed by the GUI, which selected all the air cell bodies above a certain threshold to be offloaded (see FIG. 25, step 212). The threshold pressure was indirectly chosen using a non-dimensional parameter $\gamma$ in the interval (0, 1). The parameter $\gamma$ signified the pressure threshold beyond which the air cell bodies will be offloaded. For instance, $\gamma=0.7$ implied that the pressure threshold was at 70% of the interval ($P_{min}$, $P_{max}$) in the pressure profile shown in FIG. 24(*b*). Based on $\gamma=0.7$, the GUI automatically selected and offloaded air cell bodies numbered 11, 16, 17, 18, 21, 22, 37, 42 since their pressures were higher than the determined pressure threshold. FIG. 24(*c*) shows successful offloading of pressure from the automatically selected areas. Then, the redistribution routine was initiated. The redistribution routine redistributed the residual pressure uniformly across the rest of the air cell bodies (see FIG. 25, step 208). Successful redistribution was achieved, as shown in FIG. 24(*d*), where the pressure distribution was uniform throughout the cushion while the designated areas were still offloaded.

This automated seat cushion system, with a novel scheduling bang-bang controller, was demonstrated with the proposed hardware for real time mapping, offloading, and redistribution of seating interface pressure. This system shows instantaneous local pressure measurement and automated pressure modulation, which can have a greater clinical impact for developing pressure ulcer mitigation strategies.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system comprising:

a cushioning device having a first body that defines a first plurality of cavities and a second body that defines a second plurality of cavities, wherein the cavities of the first plurality of cavities are arranged in a three-dimensional array where at least some of the cavities of the first plurality of cavities are stacked on top of other cavities of the first plurality of cavities in the first body, and wherein the second body is below the first body;

a pressure source configured to be in fluid communication with the first and second pluralities of cavities;

a first plurality of sensors configured to capture data indicative of internal pressure within the first plurality of cavities, wherein each sensor of the first plurality of sensors corresponds to a cavity of the first plurality of cavities;

a second plurality of sensors configured to capture data indicative of vibration of the cushioning device;

a plurality of valves, wherein each valve of the plurality of valves is configured to control fluid flow between the pressure source and a corresponding cavity of the first and second pluralities of cavities; and one or more controllers configured to:

actuate the pressure source to move fluid toward and/or away from one or more of the first plurality of cavities and to selectively actuate one or more valves of the plurality of valves to remove pressure from a sensitive region of a user; and actuate the pressure source to move fluid toward and/or away from one or more of the second plurality of cavities to manage the vibration of the cushioning device, wherein the cushioning device is configured to be disposed between a user and a surface on which the user is disposed upon.

2. The system of claim 1, wherein the one or more controllers are configured to be coupled to a graphical user interface (GUI) such that the one or more controllers is configured to actuate the pressure source in response to a command received by the GUI.

3. The system of claim 2, wherein the plurality of valves are configured to be actuated by the one or more controllers in response to the command received by the GUI.

4. The system of claim 2, comprising a pressure regulator configured to control fluid flow to one or more of the plurality of valves, wherein the plurality of valves are configured to be actuated by the one or more controllers in response to the command received by the GUI.

5. The system of claim 1, comprising a graphical user interface (GUI) configured to receive a command and, in response to the command, perform one or more of the following functions:

display a magnitude and/or location of pressure data within one or more of the cavities; and toggle and/or define a manual and/or automated modulation of a pressure within one or more of the cavities, wherein the modulation of the pressure can include: redistributing pressure throughout the first plurality of cavities while the plurality of cavities are subjected to a load of the user, or offloading pressure within one or more of the first plurality of cavities, or redistributing pressure within a first one of the first plurality of cavities while maintaining an offloaded pressure within a second one of the first plurality of cavities.

6. The system of claim 1, wherein one or more of the first and second pluralities of cavities are at least partially defined by a sidewall, at least a portion of the sidewall being planar, corrugated, bellowed, and/or curved.

7. The system of claim 1, wherein managing the vibration of the cushioning device comprises changing an overall vertical height of the cushioning device.

8. The system of claim 1, wherein the first body includes one or more of the following materials: polyurethane, neoprene, silicone rubber, and natural rubber.

9. The system of claim 1, where the surface is a seat of a wheelchair.

10. The method of claim 1, wherein the one or more controllers are further configured to redistribute pressure within a first one of the first plurality of cavities while maintaining an offloaded pressure within a second one of the first plurality of cavities.

11. A pad device comprising:

a first body defining a first plurality of cavities configured to be coupled to a fluid source, wherein the cavities of the first plurality of cavities are arranged in a three-dimensional array where at least some of the cavities of the first pluralities of cavities are stacked on top of other cavities of the first plurality of cavities in the first body;

a second body defining a second plurality of cavities, wherein the second body is below the first body;

a first plurality of sensors configured to capture data indicative of internal pressure within the first plurality of cavities, wherein each sensor of the first plurality of sensors corresponds to a cavity of the first plurality of cavities;

a second plurality of sensors configured to capture data indicative of vibration of the pad device;

a plurality of valves, wherein each valve of the plurality of valves is configured to control fluid flow between the fluid source and a corresponding cavity of the first and second plurality of cavities; and one or more controllers configured to:

actuate the fluid source to move fluid toward and/or away from one or more of the first plurality of cavities and to selectively actuate one or more valves of the plurality of valves to remove pressure from a sensitive region of a user; and actuate the pressure source to move fluid toward and/or away from one or more of the second plurality of cavities to manage the vibration of the pad device.

12. The pad device of claim 11, wherein the pad device is configured to be disposed between the user and a surface on which the user is disposed upon.

13. The pad device of claim 11, wherein the fluid is a hydraulic fluid and/or a pneumatic fluid.

14. The pad device of claim 11, wherein the first body includes one or more of the following materials: polyurethane, silicone, neoprene, and natural rubber.

15. The pad device of claim 11, where the surface is a cushion of a wheelchair.

16. A method for actuating a cushioning pad device having a body defining a plurality of cavities configured to be coupled to a fluid source such that the fluid source can deliver fluid to vary internal pressures of the cavities, wherein the body defines a cushioning pad configured to support a seated user, the method comprising:

sensing pressure from each cavity of the plurality of cavities;

sensing vibration of the cushioning pad using one or more vibration sensors;

generating a sensed pressure profile based on the sensed pressure from each cavity of the plurality of cavities;

displaying the sensed pressure profile on a graphical user interface;

receiving input of a desired pressure profile through the graphical user interface;

selectively varying the internal pressures of the plurality of cavities to achieve the desired pressure profile and to reduce the vibration of the cushioning pad; and displaying historical pressure data on the graphical user interface.

17. The method of claim 16, wherein the method is performed by one or more controllers.

18. The method of claim 17, further comprising identifying anatomical features based on the sensed pressure profile.

* * * * *